US011498343B2

(12) United States Patent
Stowitts et al.

(10) Patent No.: US 11,498,343 B2
(45) Date of Patent: Nov. 15, 2022

(54) CONTAINER DECORATION APPARATUS AND METHOD

(71) Applicant: Ball Corporation, Broomfield, CO (US)

(72) Inventors: Adam P. S. Stowitts, Arvada, CO (US); Dean C. Ellefson, Lakewood, CO (US)

(73) Assignee: BALL COPORATION, Westminster, CO (US)

( * ) Notice: Subject to any disclaimer, the term of this patent is extended or adjusted under 35 U.S.C. 154(b) by 299 days.

(21) Appl. No.: 16/648,874

(22) PCT Filed: Sep. 19, 2018

(86) PCT No.: PCT/US2018/051717
§ 371 (c)(1),
(2) Date: Mar. 19, 2020

(87) PCT Pub. No.: WO2019/060394
PCT Pub. Date: Mar. 28, 2019

(65) Prior Publication Data

US 2020/0276800 A1 Sep. 3, 2020

Related U.S. Application Data

(60) Provisional application No. 62/579,236, filed on Oct. 31, 2017, provisional application No. 62/560,354, filed on Sep. 19, 2017.

(51) Int. Cl.
*B41J 3/407* (2006.01)
*B41J 2/005* (2006.01)
(Continued)

(52) U.S. Cl.
CPC ..... *B41J 3/4073* (2013.01); *B41F 17/22* (2013.01); *B41J 2/0057* (2013.01); *B41J 2/01* (2013.01);
(Continued)

(58) Field of Classification Search
CPC .. B41J 3/40731; B41J 3/4073; B41J 11/0085; B41J 2/0057; B41J 3/40733; B41J 3/445;
(Continued)

(56) References Cited

U.S. PATENT DOCUMENTS 5,650,037 A 7/1997 Larson
5,774,144 A 6/1998 Eriksen
(Continued)

FOREIGN PATENT DOCUMENTS

CA 2568736 C 5/2008
DE 202006000270 U1 5/2006
(Continued)

OTHER PUBLICATIONS

US 9,597,868 B2, 03/2017, Landa et al. (withdrawn)
(Continued)

*Primary Examiner* — An H Do
(74) *Attorney, Agent, or Firm* — Greer, Burns & Crain, Ltd.

(57) ABSTRACT

A container body decorator (10) has a controller with a software stored in a memory. A plurality of ink jet print heads (108) is in communication with the controller. An endless image transfer belt (116) has a circumferential configuration with an inner surface opposite a printing surface. A printing site (124) is located along the endless image transfer belt (116). A container body handling module (200) delivers container bodies (14) to the printing site (124).

21 Claims, 30 Drawing Sheets

(51) Int. Cl.

| | |
|---|---|
| ***B65B 43/50*** | (2006.01) |
| ***B65B 61/02*** | (2006.01) |
| ***B41F 17/22*** | (2006.01) |
| ***B41J 2/01*** | (2006.01) |
| ***B41J 11/00*** | (2006.01) |
| ***B41J 3/44*** | (2006.01) |

(52) U.S. Cl.
CPC ..... *B41J 3/40731* (2020.08); *B41J 3/40733* (2020.08); *B41J 3/445* (2013.01); *B41J 11/0085* (2013.01); *B65B 43/50* (2013.01); *B65B 61/025* (2013.01); *B41J 2002/012* (2013.01)

(58) Field of Classification Search
CPC ..... B41J 2/01; B41J 2002/012; B65B 43/50; B65B 61/025; B41F 17/22
See application file for complete search history.

(56) References Cited

U.S. PATENT DOCUMENTS

| | | | |
|---|---|---|---|
| 5,970,865 | A | 10/1999 | Horth et al. |
| 6,631,673 | B2 | 10/2003 | Aichele |
| 6,699,352 | B2 | 3/2004 | Sawatsky |
| 6,769,357 | B1 | 8/2004 | Finan |
| 6,854,947 | B2 | 2/2005 | Lee |
| 6,920,822 | B2 | 7/2005 | Finan |
| 7,013,624 | B2 | 3/2006 | Zwilling |
| 7,347,899 | B2 | 3/2008 | Day |
| 7,373,878 | B2 | 5/2008 | Finan |
| 7,517,623 | B2 | 4/2009 | Wu et al. |
| 7,540,236 | B2 | 6/2009 | Aichele |
| 8,256,854 | B2 | 9/2012 | Till |
| 8,408,694 | B2 | 4/2013 | Leykamm et al. |
| 8,418,608 | B2 | 4/2013 | Preckel |
| 8,708,271 | B2 | 4/2014 | Noll et al. |
| 8,899,718 | B2 | 12/2014 | Yamada et al. |
| 8,919,247 | B2 | 12/2014 | Morgavi et al. |
| 8,926,047 | B2 | 1/2015 | LaCaze et al. |
| 8,931,864 | B2 | 1/2015 | LaCaze |
| 9,032,872 | B2 | 5/2015 | Uptergrove |
| 9,090,090 | B2 | 7/2015 | Putzer et al. |
| 9,132,664 | B2 | 9/2015 | Schach |
| 9,186,884 | B2 | 11/2015 | Landa et al. |
| 9,193,146 | B2 | 11/2015 | Till |
| 9,221,275 | B2 | 12/2015 | Till |
| 9,229,664 | B2 | 1/2016 | Landa et al. |
| 9,259,952 | B2 | 2/2016 | Yamada et al. |
| 9,272,534 | B2 | 3/2016 | Domeier et al. |
| 9,290,016 | B2 | 3/2016 | Landa et al. |
| 9,302,463 | B2 | 4/2016 | Heidrich et al. |
| 9,327,493 | B1 | 5/2016 | Vella |
| 9,327,496 | B2 | 5/2016 | Landa et al. |
| 9,353,273 | B2 | 5/2016 | Landa et al. |
| 9,365,010 | B2 | 6/2016 | Preckel et al. |
| 9,381,736 | B2 | 7/2016 | Landa et al. |
| 9,415,607 | B2 | 8/2016 | Preckel et al. |
| 9,457,926 | B2 | 10/2016 | Schach |
| 9,463,616 | B2 | 10/2016 | Domeier et al. |
| 9,498,946 | B2 | 11/2016 | Landa et al. |
| 9,505,208 | B2 | 11/2016 | Shmaiser et al. |
| 9,517,618 | B2 | 12/2016 | Landa et al. |
| 9,517,623 | B2 | 12/2016 | LaCaze |
| 9,550,372 | B2 | 1/2017 | Vella |
| 9,566,780 | B2 | 2/2017 | Landa et al. |
| 9,568,862 | B2 | 2/2017 | Schmaiser et al. |
| 2006/0018698 | A1 | 1/2006 | Vogt |
| 2007/0157576 | A1 | 7/2007 | Till |
| 2007/0182705 | A1 | 8/2007 | Leyland et al. |
| 2010/0257819 | A1 | 10/2010 | Schach |
| 2010/0295885 | A1 | 11/2010 | LaCaze |
| 2012/0044283 | A1 | 2/2012 | Silverbrook |
| 2012/0274695 | A1 | 11/2012 | LaCaze et al. |
| 2013/0019566 | A1 | 1/2013 | Schach |
| 2013/0075296 | A1 | 3/2013 | Ramsey et al. |
| 2014/0049585 | A1 | 2/2014 | Tashiro et al. |
| 2015/0024648 | A1 | 1/2015 | Landa et al. |
| 2015/0025179 | A1 | 1/2015 | Landa et al. |
| 2015/0118503 | A1 | 1/2015 | McDaniel et al. |
| 2015/0044431 | A1 | 2/2015 | Landa et al. |
| 2015/0072090 | A1 | 3/2015 | Landa et al. |
| 2015/0128819 | A1 | 5/2015 | Vella |
| 2015/0128821 | A1 | 5/2015 | Vella |
| 2015/0174891 | A1 | 6/2015 | Boas et al. |
| 2015/0174917 | A1 | 6/2015 | Noll et al. |
| 2015/0183211 | A1 | 7/2015 | Petti et al. |
| 2016/0001546 | A1 | 1/2016 | Hughes et al. |
| 2016/0016687 | A1 | 1/2016 | Ramsey et al. |
| 2016/0023471 | A1 | 1/2016 | Jeter |
| 2016/0136965 | A1 | 5/2016 | Sonnauer |
| 2016/0136968 | A1 | 5/2016 | Cassoni et al. |
| 2016/0136969 | A1 | 5/2016 | Allen et al. |
| 2016/0159087 | A1 | 6/2016 | Sonnauer |
| 2016/0200097 | A1 | 7/2016 | Shmaiser et al. |
| 2016/0207341 | A1 | 7/2016 | Landa et al. |
| 2016/0212968 | A1 | 7/2016 | Ritnour |
| 2016/0221328 | A1 | 8/2016 | Till |
| 2016/0221359 | A1 | 8/2016 | Till |
| 2016/0221360 | A1 | 8/2016 | Till |
| 2016/0221708 | A1 | 8/2016 | Ojima et al. |
| 2016/0222232 | A1 | 8/2016 | Landa et al. |
| 2016/0229198 | A1 | 8/2016 | Izume |
| 2016/0297190 | A1 | 10/2016 | Landa et al. |
| 2016/0297978 | A1 | 10/2016 | Landa et al. |
| 2016/0344896 | A1 | 11/2016 | Litvak et al. |
| 2016/0355025 | A1 | 12/2016 | Ojima et al. |
| 2016/0369119 | A1 | 12/2016 | Landa et al. |
| 2017/0008270 | A1 | 1/2017 | Fleischer et al. |
| 2017/0008272 | A1 | 1/2017 | Landa et al. |
| 2017/0050446 | A1 | 2/2017 | Clippingdale et al. |
| 2017/0056900 | A1 | 3/2017 | Cassoni et al. |
| 2017/0080706 | A1 | 3/2017 | Landa et al. |
| 2017/0113455 | A1 | 4/2017 | Landa et al. |
| 2017/0182705 | A1 | 6/2017 | Allen et al. |
| 2019/0163097 | A1 | 5/2019 | Landa |

FOREIGN PATENT DOCUMENTS

| | | | |
|---|---|---|---|
| DE | 102009058222 | A1 | 6/2011 |
| DE | 102011009391 | A1 | 7/2012 |
| DE | 202006021181 | U1 | 7/2013 |
| DE | 202006021180 | U1 | 8/2013 |
| DE | 102012213079 | A1 | 1/2014 |
| DE | 102013214934 | A1 | 2/2015 |
| DE | 102013215637 | A1 | 3/2015 |
| DE | 102013217668 | A1 | 3/2015 |
| DE | 102014206730 | A1 | 10/2015 |
| DE | 102014108092 | A1 | 12/2015 |
| DE | 102104213813 | A1 | 1/2016 |
| DE | 102014225405 | A1 | 6/2016 |
| EP | 0209896 | A2 | 1/1987 |
| EP | 1468827 | A1 | 10/2004 |
| EP | 2479036 | A1 | 7/2012 |
| JP | 2000141777 | A | 5/2000 |
| JP | 2004042464 | A | 2/2004 |
| RU | 2404065 | C1 | 11/2010 |
| RU | 2433049 | C1 | 11/2011 |
| WO | 02085553 | A1 | 4/2002 |
| WO | 2012131478 | A2 | 3/2012 |
| WO | 2016008702 | A1 | 6/2015 |
| WO | 2016008705 | A1 | 6/2015 |
| WO | 2016071444 | A1 | 11/2015 |
| WO | 2017208146 | A1 | 12/2017 |

OTHER PUBLICATIONS

Russian Search Report and Office Action for corresponding Russian Patent Application No. 2020112904 dated Jan. 29, 2021.
International Search Report; priority document.

CONTAINER DECORATION APPARATUS AND METHOD

CROSS-REFERENCE TO RELATED APPLICATIONS

This Application is a United States National Stage Application under 35 U.S.C. Section 371 of International Patent Application No. PCT/US2018/051717 filed on Sep. 19, 2018, which is hereby incorporated by reference as if fully set forth herein. This Application also claims priority to and the benefit of U.S. Provisional Application No. 62/560,354, filed Sep. 19, 2017, and U.S. Provisional Application No. 62/579,236, filed Oct. 31, 2017, which are also hereby incorporated by reference as if fully set forth herein.

FEDERALLY SPONSORED RESEARCH OR DEVELOPMENT

N/A

TECHNICAL FIELD

The invention relates to container decoration; more particularly, the invention relates to an apparatus for continuously decoration, without interruption, a queue of beverage cans with selectively differing designs.

BACKGROUND OF THE INVENTION

Recent developments in metallic beverage container body decorating allow manufacturers to produce consecutively decorated beverage container bodies having unique finished art relative to each other on a single dry offset beverage container body decorator. Prior to these recent developments, consecutively decorated beverage container bodies exhibited identical finished art. Some of these recent developments are disclosed in U.S. Patent Application Publication No. 2015/0174891 A1 corresponding to U.S. application Ser. No. 14/412,585, which is hereby incorporated by reference as if fully set for herein and for a particular purpose of describing the dry rotary offset printing process as it relates to metallic beverage container bodies for two-piece beverage containers.

In a typical dry rotary offset beverage container body decorator, cartridges are supplied with colored ink that is eventually applied onto a cylindrical sidewall of the metal beverage container body. The printing apparatus is provided with an ink cartridge for each color that one wishes to apply onto the metal beverage container body.

The ink cartridges supply ink to printing plates, which have art in relief corresponding to finished art to be printed onto the metal beverage container. This finished art may be a text, a figure, or any type of graphic which one wishes to make on a metal beverage container. Thus, it is very important to position the printing plate correctly relative to the metal beverage container and the ink cartridges.

It is also important to note that the relief art present on the printing plates is in high relief wherein ink supplied to the art in high relief on the printing plates transfers to a transfer blanket. This transfer blanket is an ink transferring means between the printing plates and the metal beverage container to be printed, generally produced from a rubber, rubber-like, or other pliable material.

The ink-laden relief features on each printing plate come into contact with a single transfer blanket. Thus, each transfer blanket receives ink from a plurality of printing plates to produce a finished artwork design. This is carried out by rotation of a printing plate, which transfers the ink present in relief to the transfer blanket, which is fixed on a transfer blanket drum, which has a rotation synchronized with (i) the metal beverage container bodies to be printed, (ii) the positioning of the transfer blankets that are on the surface of the transfer blanket drum, and (iii) the printing plates.

Each beverage container body engages just one transfer blanket to receive a complete finished art design of multiple colors that the transfer blanket has received from a plurality of printing plates.

The synchronization between elements makes it possible to decorate the metal beverage container bodies in a precise manner. This is of the utmost importance in metal beverage container printing. There should be no overlapping of the print on the metal beverage container when it receives ink corresponding to the art exhibited by the plurality of printing plates from a single transfer blanket.

In other words, the art on a first printing plate will transfer ink only to a predetermined area of a first transfer blanket. A second printing plate will transfer ink on its surface to another area on the first transfer blanket that did not receive ink from the first printing plate, and so on. This is dependent on the number of printing colors on the metal beverage containers.

It is also important to note that, when one wishes to change the finished art present on the beverage container bodies in a manufacturing queue, it is necessary to interrupt the production, that is, the decoration apparatus must be stopped. Such stoppage is necessary, because there may be the need to change the printing color of the beverage container body, or to change a beverage container body for a different product.

For example, when one is carrying out a type of beverage container body decoration and wants to change the finished art present on the beverage container bodies, it is necessary to interrupt the decorating process. In short, typical decorating processes and equipment, only allow one type of finished art printed on the beverage container bodies with the same decoration apparatus. If it is necessary to change the finished art on the beverage container body, the production will necessarily have to be interrupted, which for economical reason should be minimized as much as possible.

This can be easily observed through the order or magnitude of beverage container body decorating. With the present-day equipment, one can decorate approximately 2.5 million beverage container bodies in a single day.

A recent development in beverage container body decorating includes providing art in the form of relief features on the transfer blankets. Thus, rather than having a single flat surface that receives ink from the printing plates, each transfer blankets has art in relief, typically low relief engravings or cooperating regions in high and low relief, to produce differing final images on consecutively decorated metallic beverage container bodies on a dry offset rotary beverage container body decorator. This recent improvement allows a manufacturer to decorate beverage containers bodies in a manufacturing queue continuously and without interruption wherein consecutive beverage container bodies are decorated with different images.

However, this prior process limits the manufacturer to a maximum of N different designs on N consecutively decorated beverage container bodies, where N is the number of transfer blankets on a given decorating apparatus. There is a need within the industry to produce an unlimited number of finished art designs on consecutively decorated beverage container bodies within the industry.

Additionally, small-batch beverage producers are becoming increasingly more popular. Unfortunately, due to the economies associated with producing decorated beverage container bodies, small-batch beverage produces can be limited to purchasing unadorned beverage container bodies and will often add a sleeve of some sort to adorn the beverage container bodies with source identifying indicia.

The present invention is provided to solve the problems discussed above and other problems, and to provide advantages and aspects not provided by prior beverage can decorators of this type. A full discussion of the features and advantages of the present invention is deferred to the following detailed description, which proceeds with reference to the accompanying drawings.

SUMMARY OF THE INVENTION

One aspect of the invention is directed to a container body decorator which comprises a controller having a software routine stored on a memory, a plurality of ink-jet print heads in communication with the controller, an endless image transfer belt having a circumferential configuration with an inner surface opposite a printing surface, a printing site, and a beverage container body handling module.

Another aspect of the invention is directed to a container body decorator which comprises a controller having a software routine stored on memory, an endless image transfer belt driven by a plurality of rollers operatively joined to at least one servo motor, the endless image transfer belt having a printing surface opposite an inner surface, a plurality of ink-jet printing heads mounted along a circumference of the endless belt and configured to deposit an ink pattern onto the printing surface of the endless belt, the plurality of ink-jet printing heads responsive to a signal received from the controller corresponding to a desired shape and color the ink pattern, a pressure member located within the circumference of the endless belt and engaging the inner surface of the endless belt at a printing site of the container body decorator, an impression roll located opposite the pressure member such that endless image transfer belt passes therebetween defining a printing site, and a beverage container body handling module comprising a rotational indexer configured to sequentially transport a plurality of beverage container bodies to and from the printing site.

Another aspect of the present invention is directed to a container body decorator which comprises a controller having a software routine stored on memory, an endless belt driven by a plurality of rollers operatively joined to at least one servo motor, the endless belt having a printing surface opposite an inner surface, a plurality of ink-jet printing heads mounted along a circumference of the endless belt and configured to deposit an ink pattern onto the printing surface of the endless belt, the plurality of ink-jet printing heads responsive to a signal received from the controller corresponding to a desired shape and color the ink pattern, a pressure member located within the circumference of the endless belt and engaging the inner surface of the endless belt at a printing site of the container body decorator, and a beverage container handling module. The beverage container handling module comprises a first rotary delivery turret having a plurality of pockets configured to transfer each beverage container body in a queue of a plurality of beverage container bodies sequentially to a rotary print turret, the rotary print turret having a plurality of pockets configured to transfer each beverage container body in the queue of the plurality of beverage container bodies sequentially to a printing site arranged along a circumference of the endless belt, the rotary turret rotatable about an axis to sequentially bring each pocket to the printing site, a plurality of impression rolls insertable within an interior of a beverage container body wherein one impression roll of the plurality of impression rolls is located within the interior of the beverage container body when the beverage container body is located at the printing cite, the one impression roll supporting a sidewall of the beverage container body such that the sidewall is positioned between the one impression roll and the printing surface of the endless belt, a second rotary delivery turret having a plurality of pockets configured to transfer each beverage container body in a queue of a plurality of beverage container bodies sequentially from the rotary print turret to a further process.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Referring generally to the figures, embodiments of the present invention are illustrated. Each embodiment is directed to a container decorating apparatus or decorator 10. The containers may be any metallic, generally cylindrical container, such as those used in packaging solids, liquids, foods, aerosols, beverages and the like, but are preferably the body portion of a two-piece aluminum beverage can. In each embodiment, container bodies are fed or transferred sequentially, one-by-one, via one or more container body handling modules to a printing site where finished art is transferred from an image transfer belt to the container body.

Figure 20:
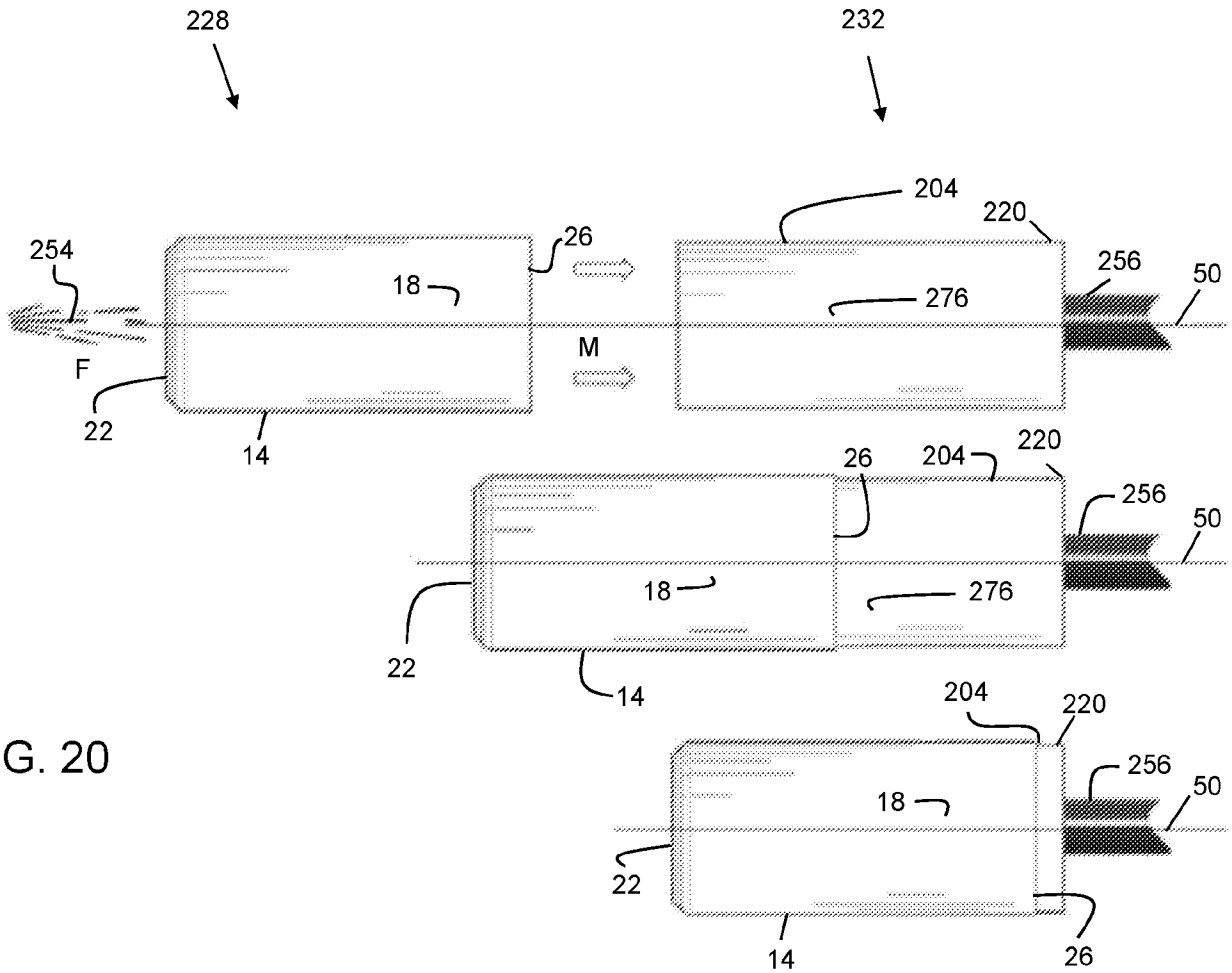
FIGS. 20 and 21 show a process of loading and unloading a beverage can on and from an impression roll.
Figure 21:
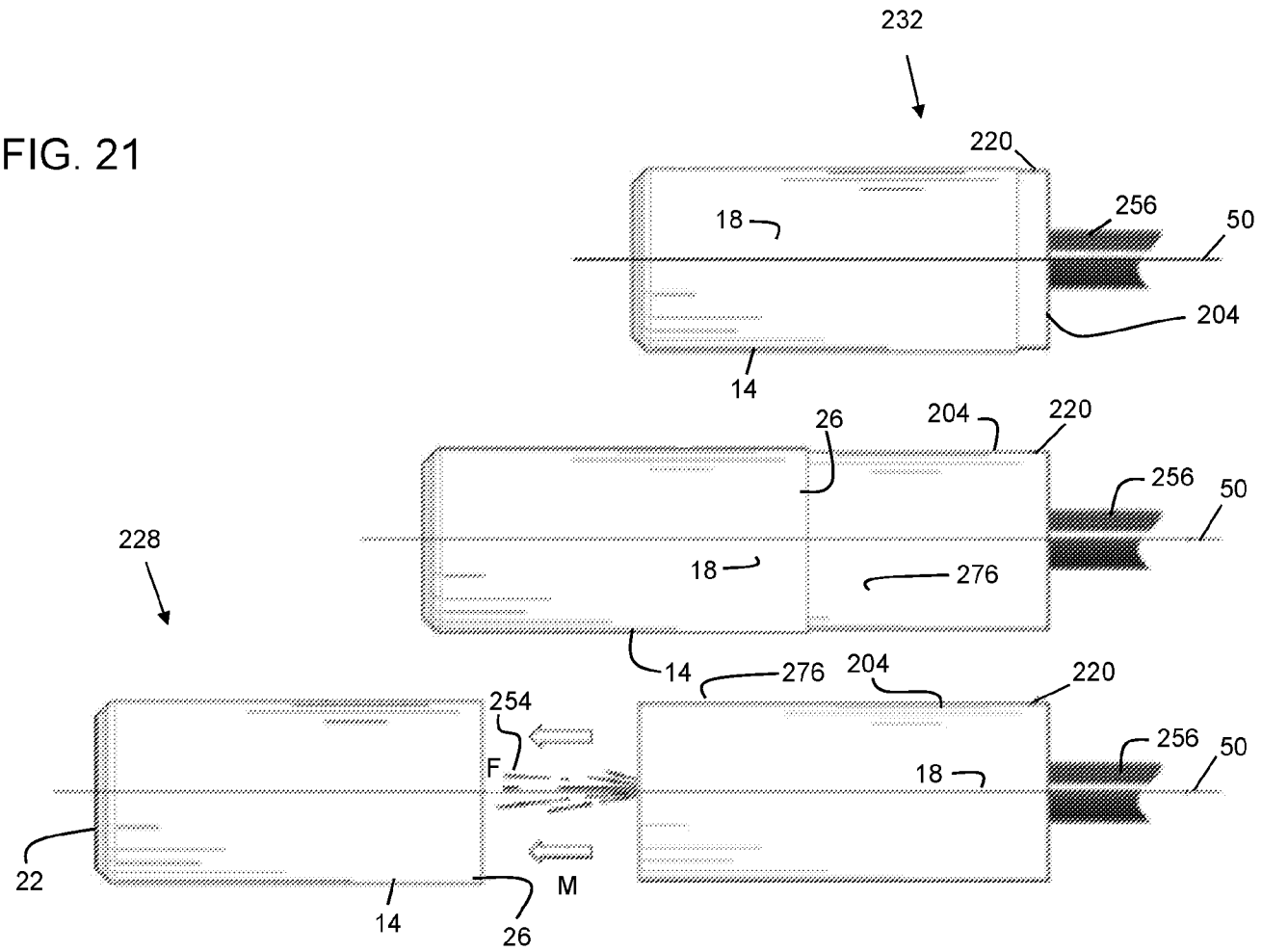

An example of one such beverage container body 14 is illustrated in FIGS. 20 and 21. The beverage container bodies 14 have a cylindrical sidewall 18 enclosed by an integral bottom 22 opposite an open end 26. Again, while the embodiments are described relating to the decorating of metallic beverage container bodies, in practice the container bodies can be intended for any of the end uses describes above.

Figure 29:
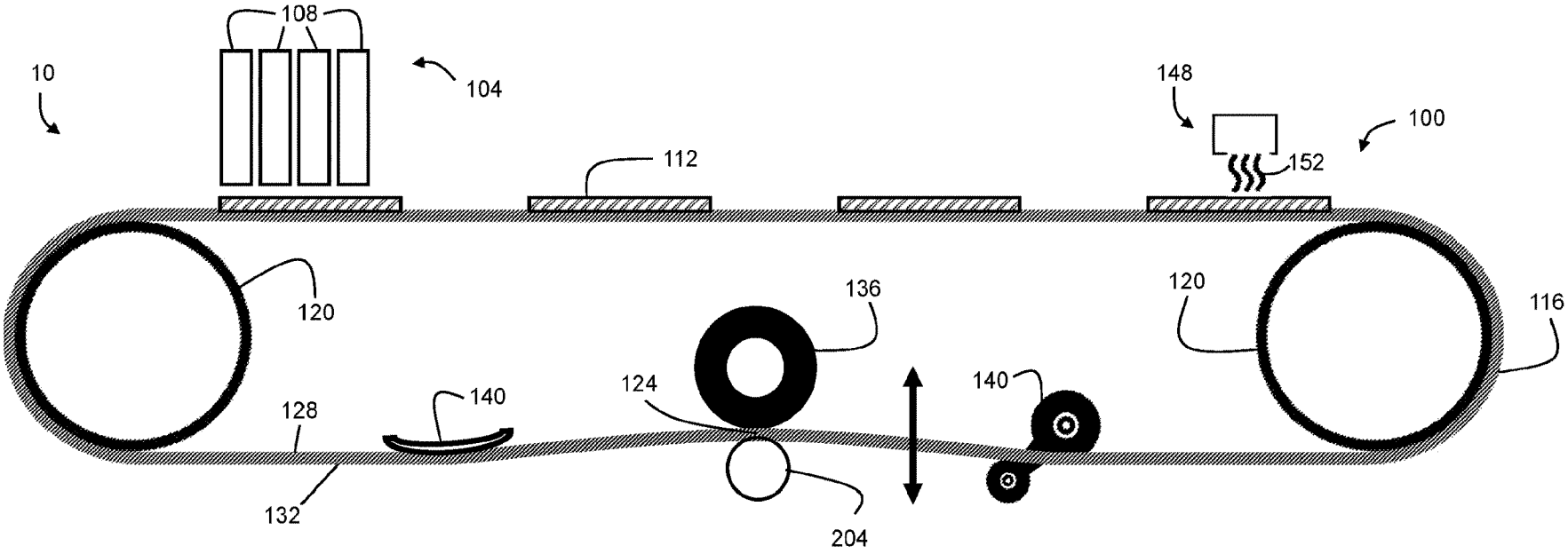
FIG. 29 shows an alternative tensioning arrangement utilizing a tension roll and a tension shoe engaging the inner surface of the endless image transfer belt wherein the tension roll is a two-roller tensioner.
Figure 30:
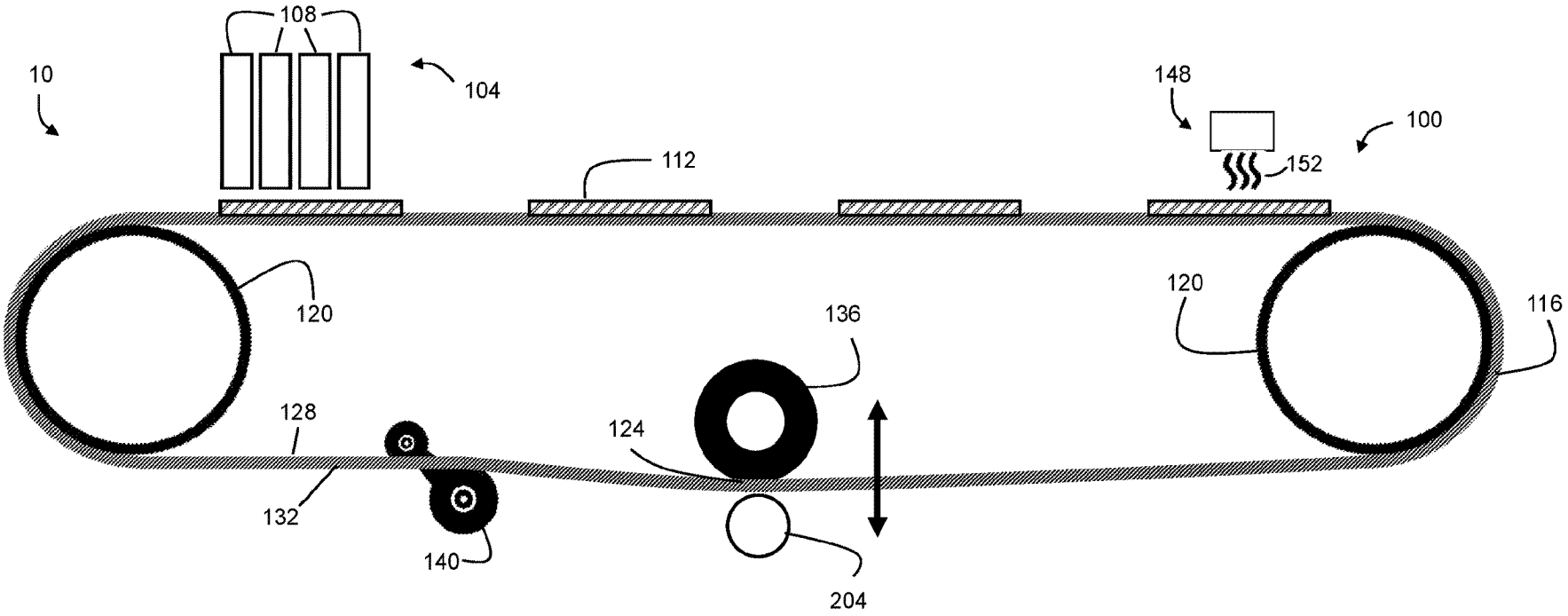
FIG. 30 shows an alternative tensioning arrangement utilizing a backside, downstream from the printing site, a two-roller tensioner.

Another example of a beverage container body 14 is illustrated in FIGS. 29 and 30. Here, the beverage container bodies 14 have been necked to reduce the size of the opening in the open end 26 and flanged for receiving a can end or lid which will be double seamed to the container body 14 subsequent to filling with a beverage or other liquid. Again, while the embodiments are described relating to the decorating of metallic beverage container bodies, in practice the container bodies can be intended for any of the end uses describes above.

Embodiments of the present invention have at least one printing module, at least one beverage container handling module, and a controller or processor generally included in a computer system comprising a memory having one or more software routines stored thereon. These three elements work together to adorn beverage container bodies 14 with a pattern of ink in a desired design, preferably multiple desired ink designs directly on a metallic sidewall of the beverage container body, rather than on a paper, polymeric, or other such printable substrate label. Elements of the printing module are designated using reference numerals between 100-199. Elements of the beverage container handling module are designated with reference numerals between 200-299.

Generally, the embodiments described provide many technical benefits and effects over prior decorators. For example, these embodiments reduce or eliminate lost production due to equipment changeovers (e.g., printing plates, blankets, ink cartridges, ink colors, and the like) where finished art or designs on the containers are changed or altered. Variability from container to container is reduced. The printing or decorating is made simpler as there is no longer a need for multiple, individual transfer blankets and a custom ink color inventory. Finally, the color pantone and method of using the apparatus allows for true artistic screening through color combination and tonal shading that is not available in dry offset printing apparatuses where overlap of ink is avoided.

Printing Modules

Each embodiment of the present invention includes a printing module 100. The printing module 100 has an inker unit 104 comprising a plurality of print heads 108, typically 4 and preferable inkjet print heads. The print heads 108 deliver a volume of ink 112 in a desired pattern to an image transfer belt 116. Each inkjet head 108 delivers a quantity of ink 112 to the belt 116 to produce a desired pattern of ink 112 in a desired color, preferably multiple colors.

The image transfer belt 116 is supported on the module by one or more rollers 120 which impart rotational movement to the image transfer belt 116, such that the ink 112 pattern traverses from a location adjacent the print heads 108 to a printing site 124 where engagement (i.e. contact) between the sidewall of the beverage container body and the image transfer belt 116 transfers the ink 112 to impart the finished art directly on the sidewall.

The image transfer belt 116 of the present invention is an endless belt. The image transfer belt 116 forms a circumferential member having an inner surface 128 opposite a printing surface 132. The printing surface 132 is configured to accept the volume of ink 112 from the inkjet heads 108 and transfer the ink 112 to the beverage container body sidewalls 18. The inner surface 128 engages the rollers 120 which drive the image transfer belt 116.

Figure 24:
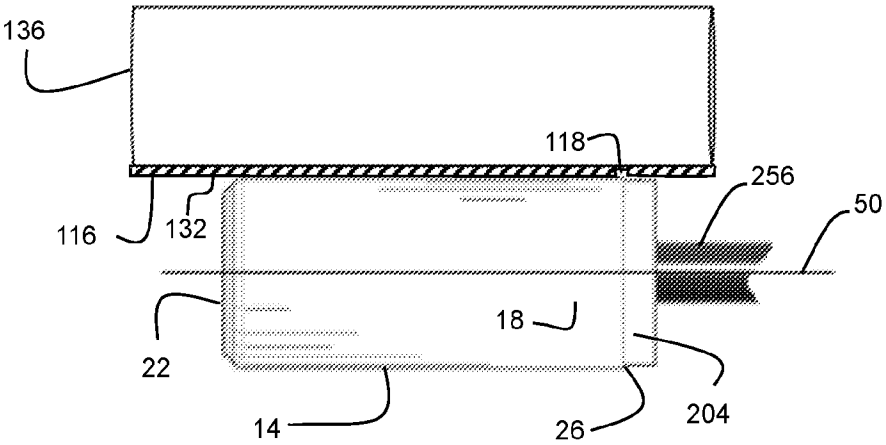
FIG. 24 is a side view of beverage can decoration process.

The image transfer belt 116 of the present invention may include recessed low relief features 118 thereon. The low relief feature 118 may be continuous artwork, such as a ribbon or the like. As illustrated in FIG. 24, relief feature 118 may be a recessed band recessed into the print surface 132 of the endless image transfer belt 116 and configured to align with an edge of an open end 26 of a beverage container body 14 such that the edge is spaced from the printing surface 132 during a transfer of ink from the endless image transfer belt 116 to the beverage container body 14.

The image transfer belt 116 is endless. In other words, it forms a continuous circumferential member. This form can be created by fixing ends of an elongated member together by any suitable chemical or mechanical means, such as welding, adhesives, clips, etc. Alternatively, the image transfer belt 116 can be integrally formed such that there is no seam between end thereof. The image transfer belt 116 is stretched about a series of tension members 140 which maintain tension in the image transfer belt 116 and drive the image transfer belt 116 on a circumferential path. Accordingly, one or more of the tension members 140 may be rollers driven by a servo motor or the like which is synchronized appropriately with a rotational indexer 212 wherein ink 112 on the printing surface 132 of the image transfer belt 116 is transferred to beverage container bodies 14 at the printing site 124.

Figure 1:
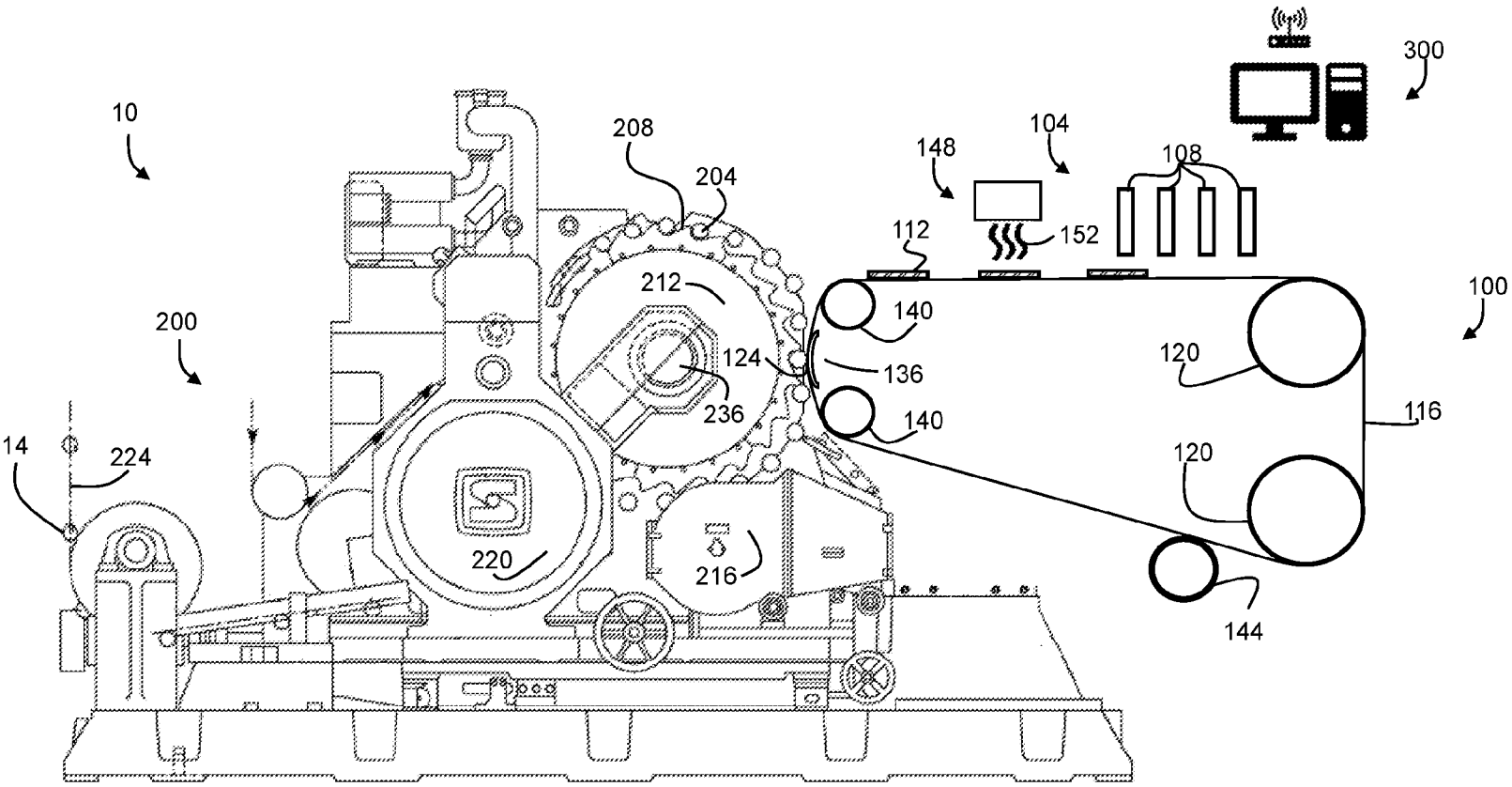
FIG. 1 is a side plan view of an offset printing apparatus according to the invention incorporating with a printing site having a pressure member in the form of a curved anvil or plate including a continuous image transfer belt a plurality of print heads, and a computer for controlling a beverage container body decorating process, including image generation and apparatus mechanical function.
Figure 2:
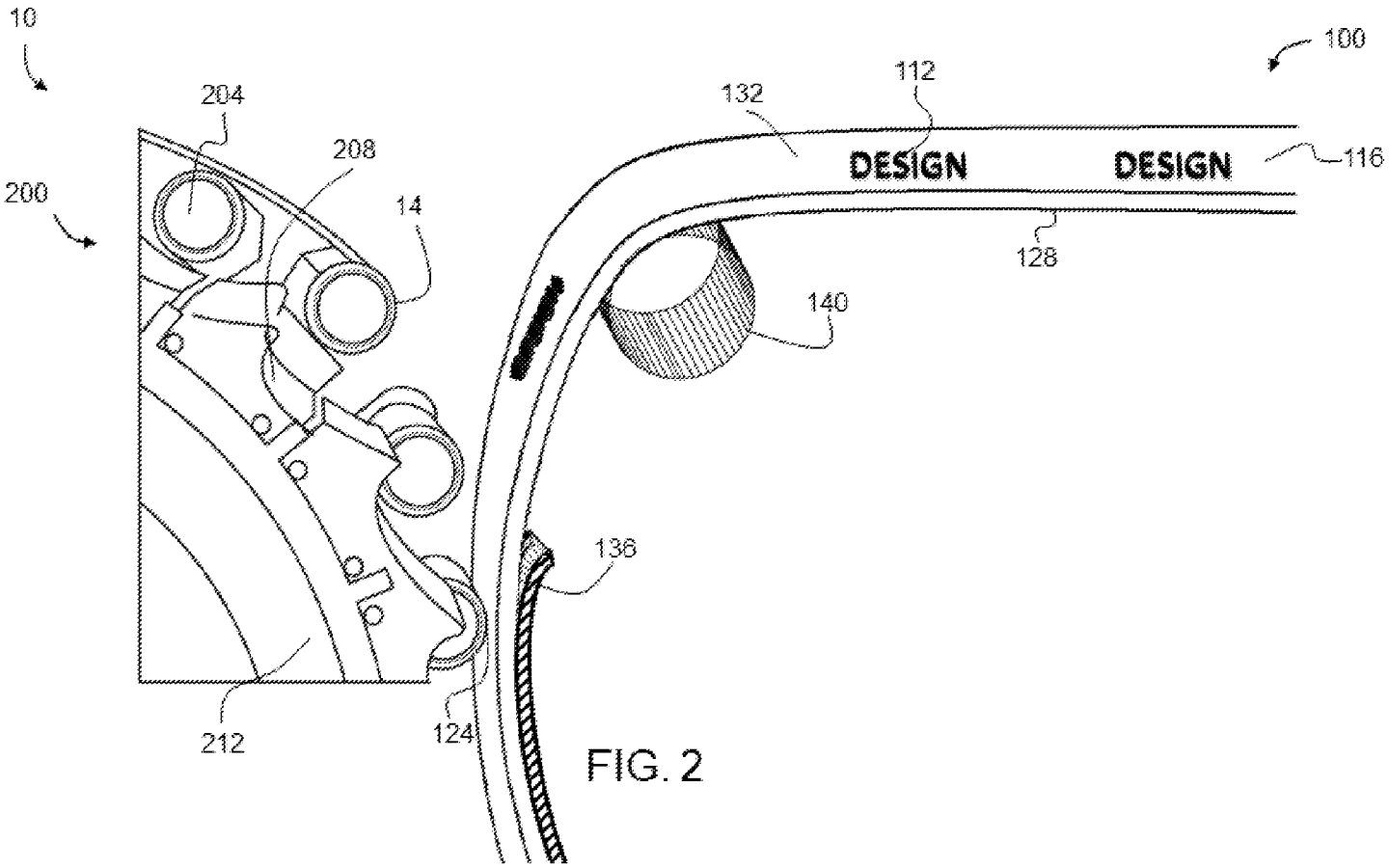
FIG. 2 is a partial view of an offset printing apparatus similar to FIG. 1 showing a printing site.
Figure 3:
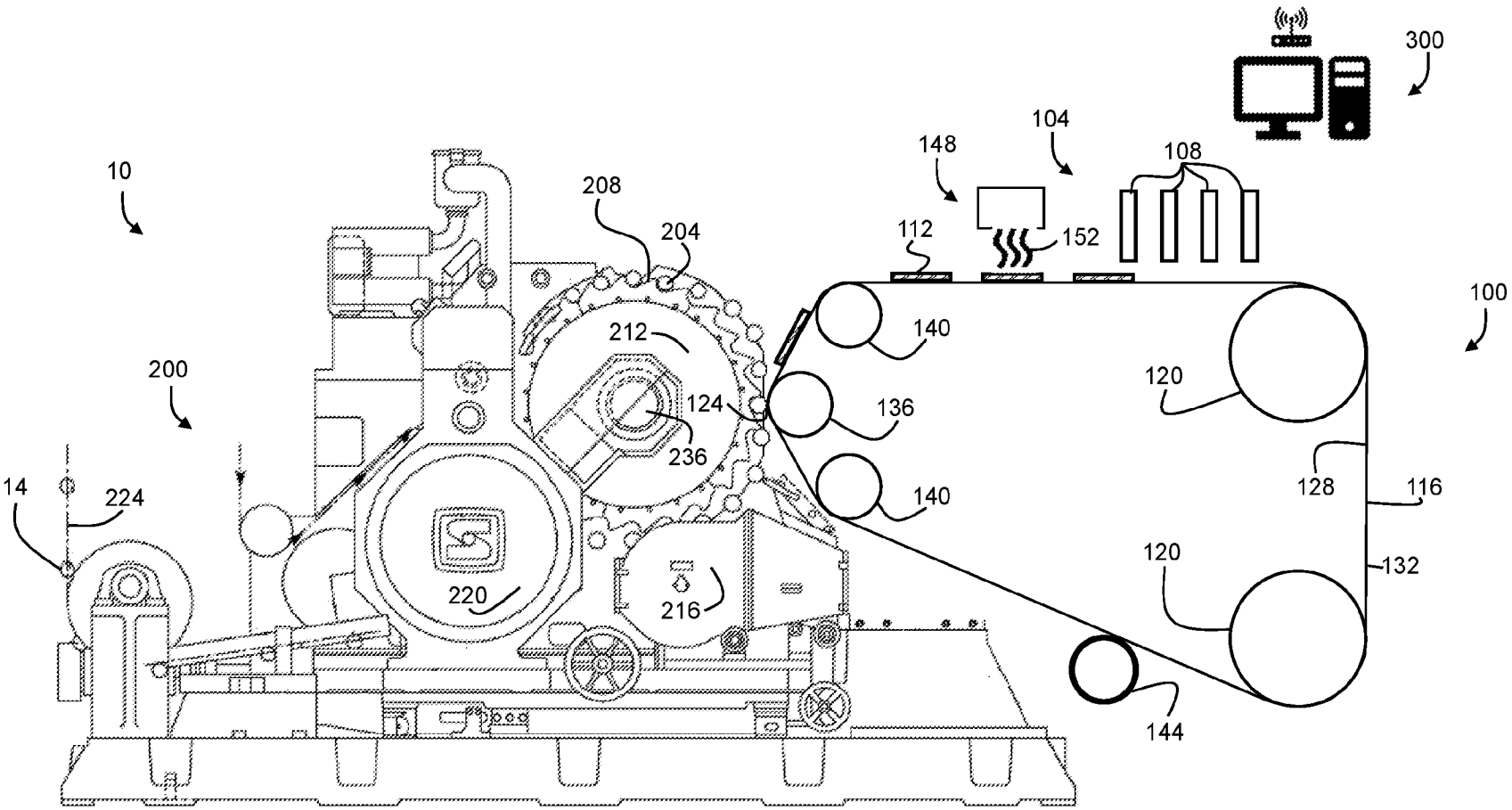
FIG. 3 is a side plan view of an offset printing apparatus according to the invention incorporating with a printing site having a pressure member in the form of a roll, including a continuous image transfer belt a plurality of print heads, and a computer for controlling a beverage container body decorating process, including image generation and apparatus mechanical function.
Figure 4:
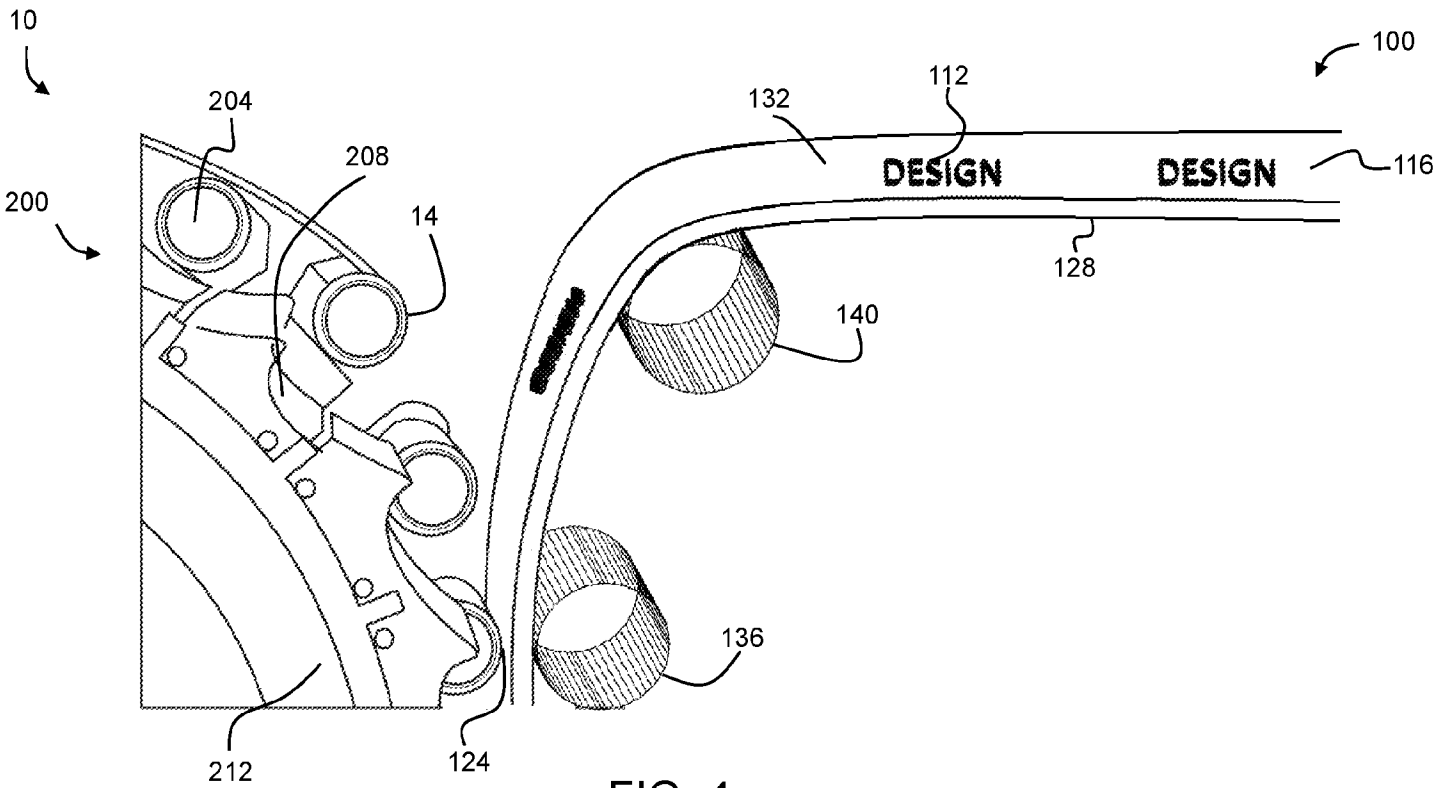
FIG. 4 is a partial view of an offset printing apparatus similar to FIG. 3 showing a printing site.
Figure 22:
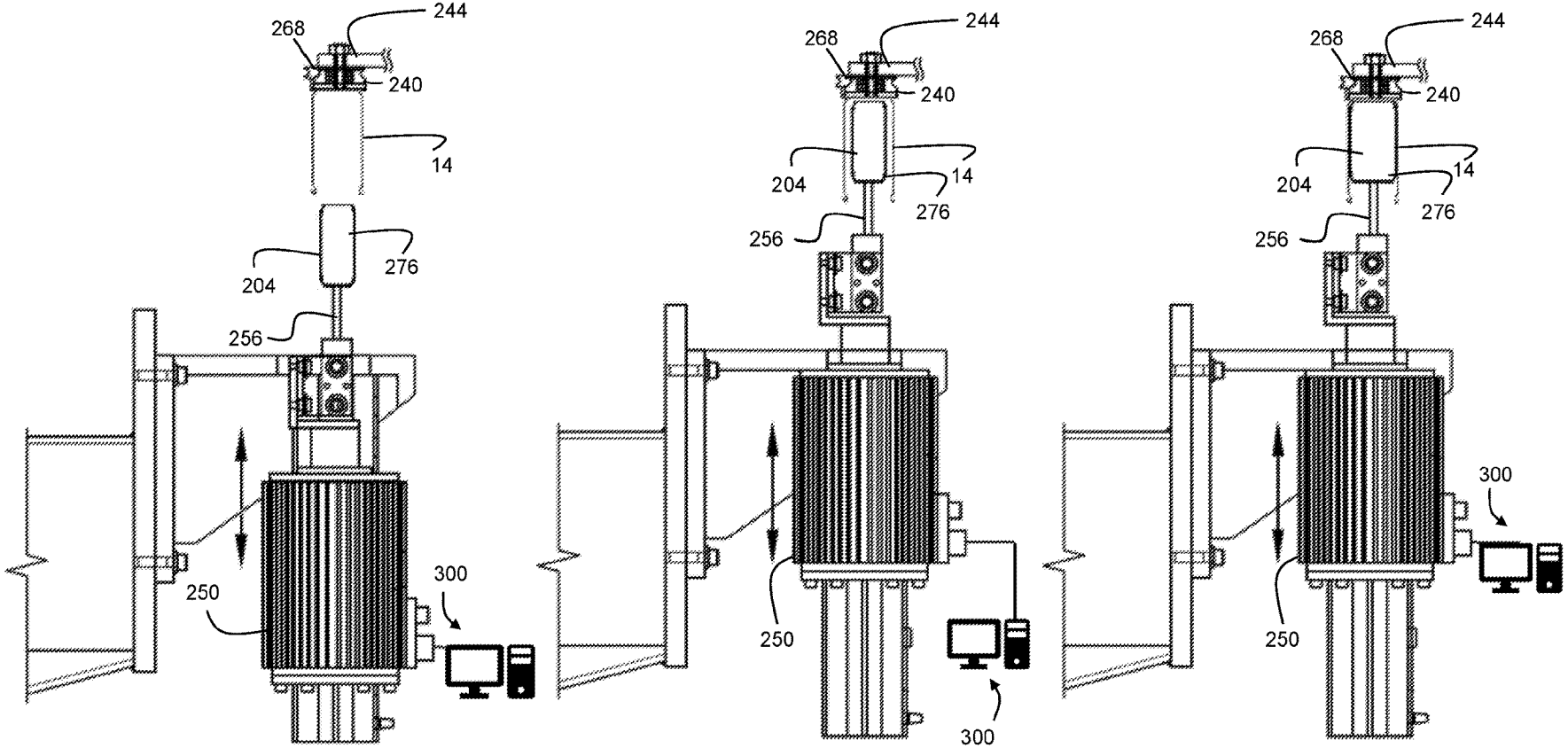
FIG. 22 is a top view of an arrangement for transferring an electroactive polymer impression roll into and out of a necked and flanged beverage container body at a printing site which can be used in combination with the beverage container body handling modules illustrated in FIGS. 10-18.

At the printing site 124, the image transfer belt 116 is sandwiched between a pressure member 136, such as an anvil (see FIG. 1), pressure roll (see FIG. 3), plate (see FIG. 4), or the like, in communication with or contacting the inner surface 128 of the image transfer belt 116 and an impression roll 204 on which a beverage container body 14 is supported (see, e.g. FIG. 22). Different Pressure members 136, such as the rolls, anvils, and plates shown in the drawings can generally be used interchangeably on the various embodiments illustrated. However, in a continuous process, as opposed to an indexing process utilizing dwell periods, it is preferably to employ pressure plates and anvils to increase a printing site 124 length beyond a single point printing cite 124 that results from utilizing a pressure roll.

The ink 112 pattern is transferred to the beverage container body sidewall 18 by compressive force between the pressure member 136 and the impression roll 204 on the beverage container body sidewall 18 and the image transfer belt 116. More specifically, the pressure member 136 engages the inner surface 128 of the image transfer belt 116 at the printing site 124 such that printing surface 132 carrying the desired pattern of ink 112 is forced against one of the plurality of beverage container bodies 14 supported on an impression roll 204 as the beverage container body 14 rotates about a center axis of the impression roll 204 as the impression roll 204 also orbits a central hub 236.

The printing site 124 may be arranged for horizontal delivery of the ink 112 on the belt 116 to the beverage container body as illustrated in, for example, FIGS. 1, 3, 14, and 15. Accordingly, at the printing site, the belt 116 is traversing substantially vertically for at least a region in which the belt 116 is in contact with the beverage container body. This region may be a mere point along the circumferential path of the belt 116 where a line tangent to region is substantially vertical (i.e. ±5° of vertical), more preferably vertical.

Alternatively, the printing module 100 can be configured such that the ink 112 is delivered vertically. Accordingly, at the printing site, the image transfer belt 116 is traversing substantially horizontally for at least a region in which the image transfer belt 116 is in contact with the beverage container body 14. This region may be a mere point along the circumferential path of the image transfer belt 116 where a line tangent to region is substantially horizontal (i.e. ±5° of horizontal), more preferably horizontal. (See, e.g., FIGS. 5-9).

The pressure member 136 is positioned at the printing site 124. The pressure member 136 ensures a proper application of force between the image transfer belt 116 and the impression roll 204 to effect ink 112 transfer to the beverage container bodies 14.

Tension members 140 may be located on opposing sides of the pressure member 136. The tension members 140 are provided to maintain proper tension of the image transfer belt 116 before, during, and after image transfer to the beverage container bodies 14. These tension members 140 may be driven or freewheeling but are preferably adjustable such that the tension in the image transfer belt 116 can be varied across the pressure member 136.

Tensioning if the endless image transfer belts 116 is vitally important to proper ink transfer from the endless image transfer belt 116 to the beverage container bodies 14. Deflection, twisting, vibration, oscillation, or other movements by the endless image transfer belt 116 prior to, during, and subsequent to printing causes poor ink transfer in terms of registration (i.e. alignment) between the image to be transferred carried by the endless image transfer belt 116 and the beverage container body 14 to be decorated. As illustrated in FIGS. 25-30 several different tensioning member configurations are contemplated by the inventors to overcome unwanted movement by the endless image transfer belt 116 relative to the article to be printed.

Figure 25:
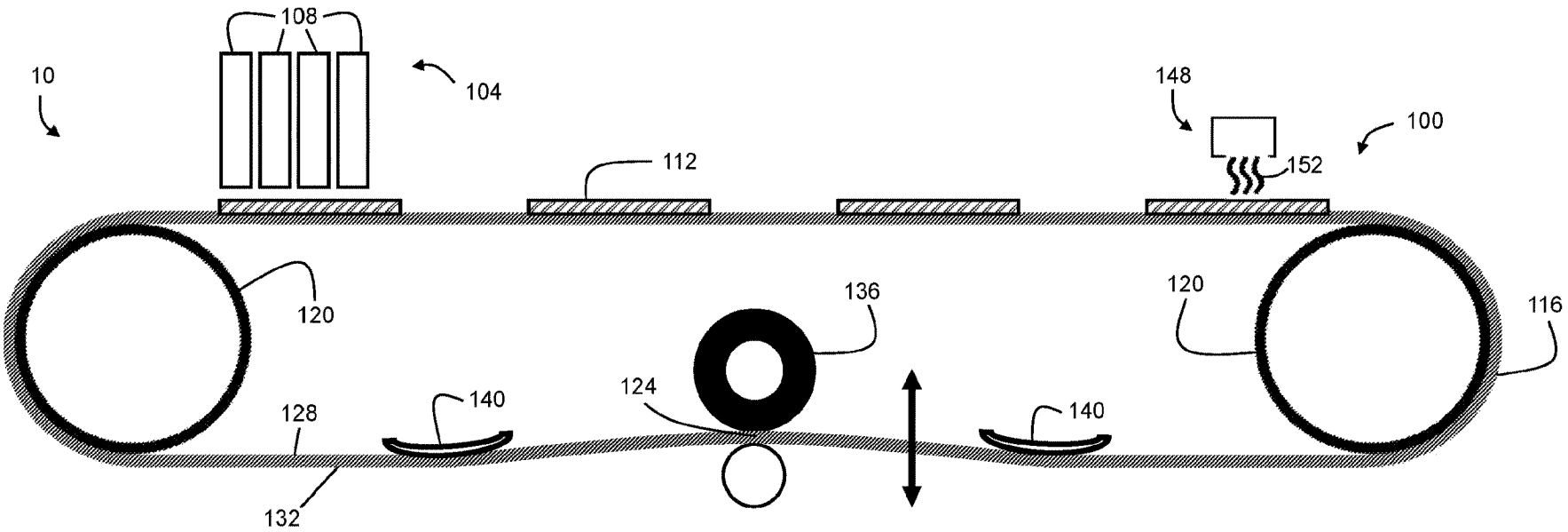
FIG. 25 shows an alternative tensioning arrangement utilizing shoe tensioners engaging the inner surface of the endless image transfer belt.
Figure 26:
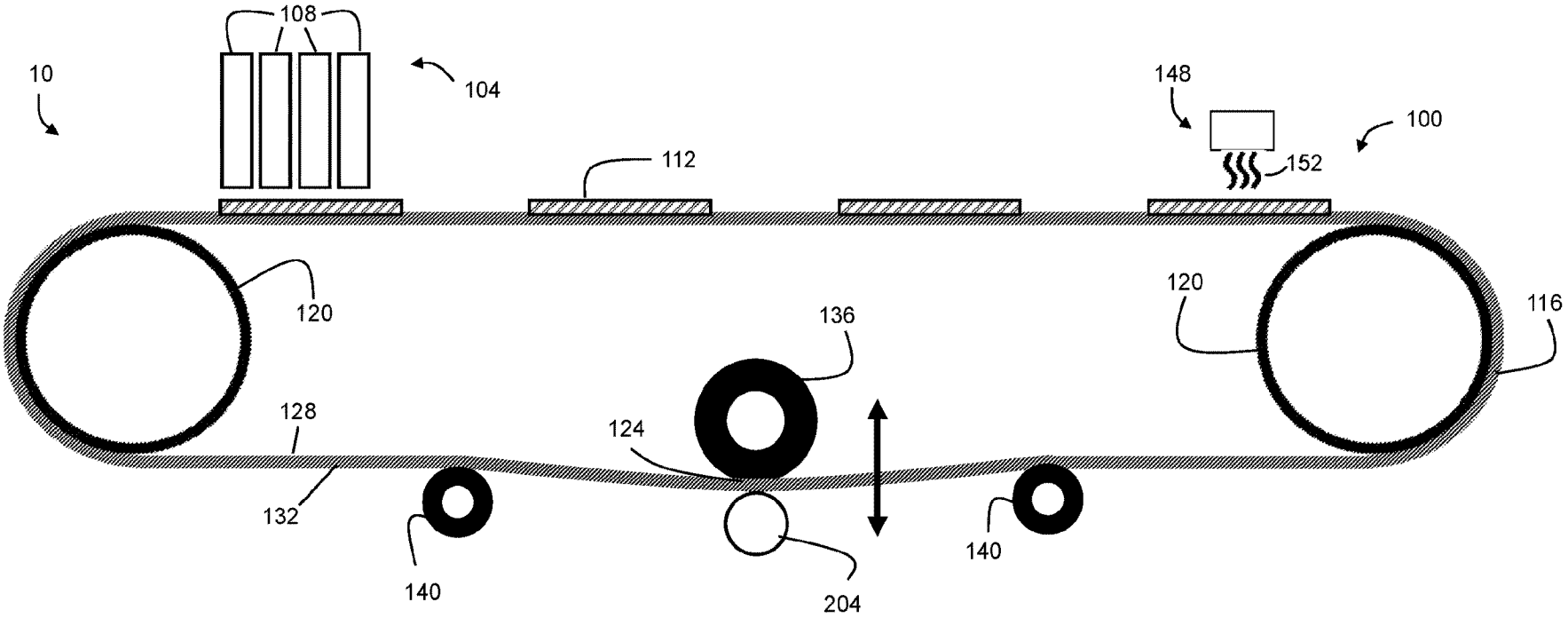
FIG. 26 shows an alternative tensioning arrangement utilizing tension rolls engaging the print surface of the endless image transfer belt.
Figure 27:
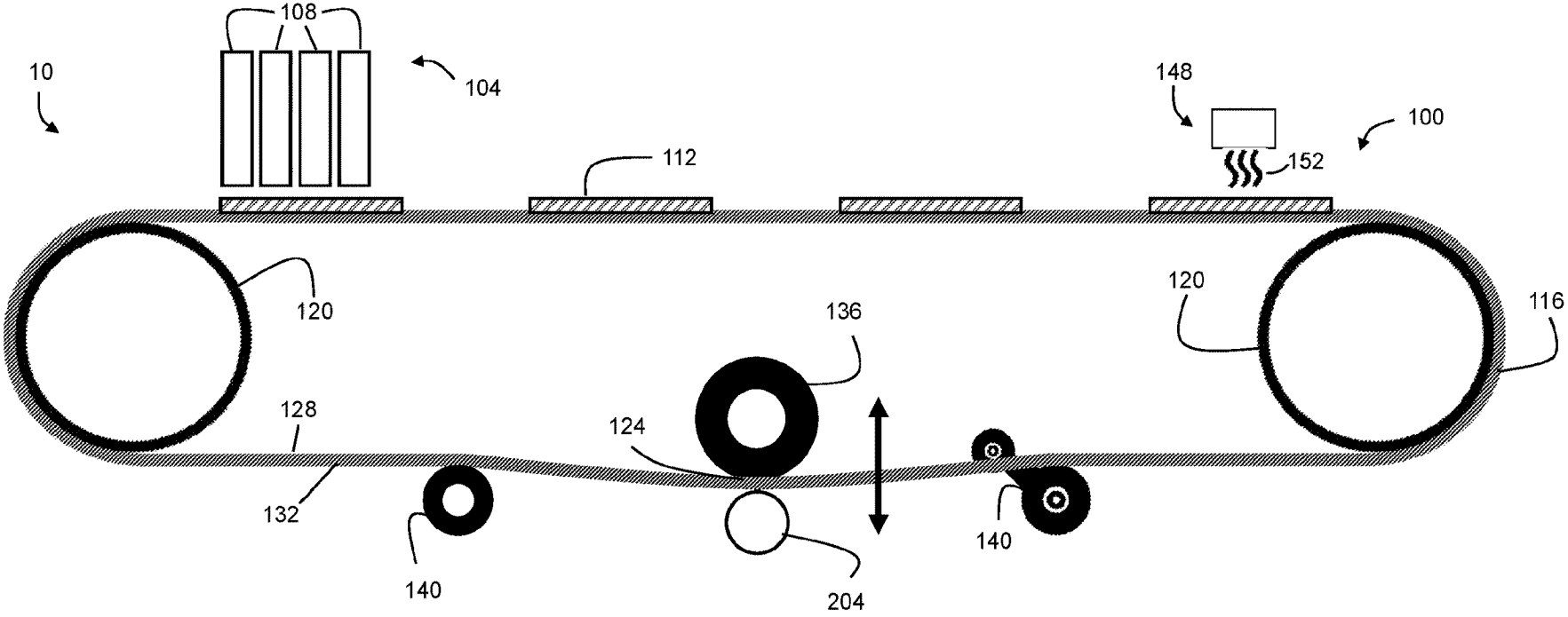
FIG. 27 shows an alternative tensioning arrangement utilizing tension rolls engaging the print surface of the endless image transfer belt wherein one tension roll is a two-roller tensioner.
Figure 28:
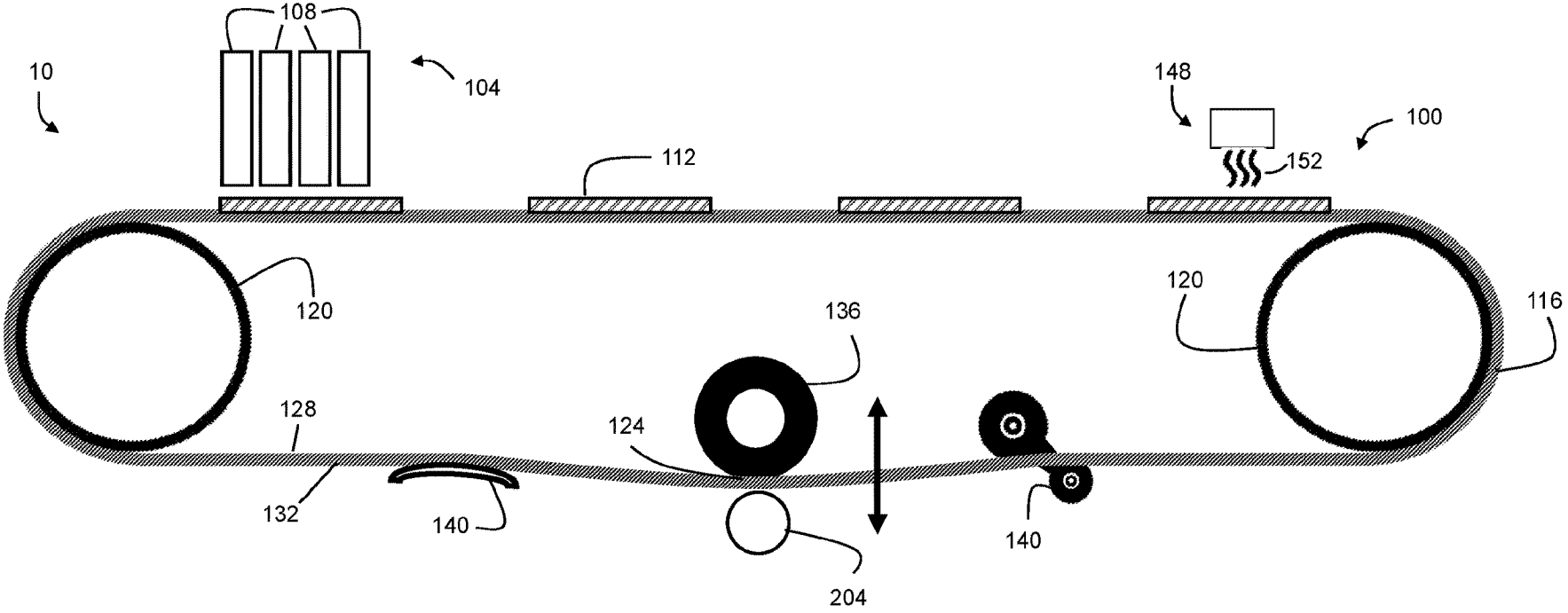
FIG. 28 shows an alternative tensioning arrangement utilizing a tension roll and a tension shoe engaging the print surface of the endless image transfer belt wherein the tension roll is a two-roller tensioner.

In FIG. 25, shoe tensioners are provided upstream and downstream of the printing site 124. In FIG. 26, tension rollers are provided upstream and downstream of the printing site 124. An upstream, two-roller tensioner is added to the embodiment of FIG. 27. In FIG. 28, the tension roll of FIG. 27 is replaced with a shoe tensioner downstream of the printing site 124 and in engagement with the printing surface. In FIG. 29, the tension members 140 of FIG. 28 engage the inner surface of the endless image transfer belt 116. In FIG. 30, a two-roller tensioner is downstream of the printing site 124 with no tension member located immediately opposite the printing site 124.

Additional strategically positioned servo drives may be implemented for sectioning off endless image transfer belt 116 noise/vibrations/oscillations spaced from printing sites 124.

Drive rolls 120 are positively driven by suitable means and timed with the beverage container handling module 200.

These drive rolls 120 impart a counterclockwise or clockwise movement to the belt 116 as desired or designed.

A cleaning roll 144 may be provided downstream from the printing site 124 to remove ink 112 that is not transferred from the image transfer belt 116 to the beverage container bodies 14 from the image transfer belt 116. Accordingly, the cleaning roll 144 engages the printing surface 132 of the image transfer belt 116 as the image transfer belt 116 traverses along its circumferential route back by the print heads 108.

The printing module 100 may be outfitted with an ink curing station 148. This ink curing station 148 may comprise a source of heat 152. The heat 152 pre-cures the ink 112 on the image transfer belt 116 to minimize wet on beverage container body 14 issues. This creates a more stable ink 112 as an ink image or pattern prior to transferring the ink 112 to the beverage container body 14. Due to printing to the image transfer belt and pre-curing, multiple color dots can be combined to generate a larger color pantone options with base colors.

These printing modules 100 allow a one-touch application of an entire graphic which allows for a more simply built decorator 10 than prior art offset decorators which require wet laydown for each color. Continuous application of ink 112 onto the image transfer belt allows for the limiting speed factor of the print head 108 to be maximized. Print head 108 jetting onto a receptive image transfer belt in a repeatable position/condition belt as opposed to a moving round beverage container body with a variable surface leads to consistency and speed.

Figure 18:
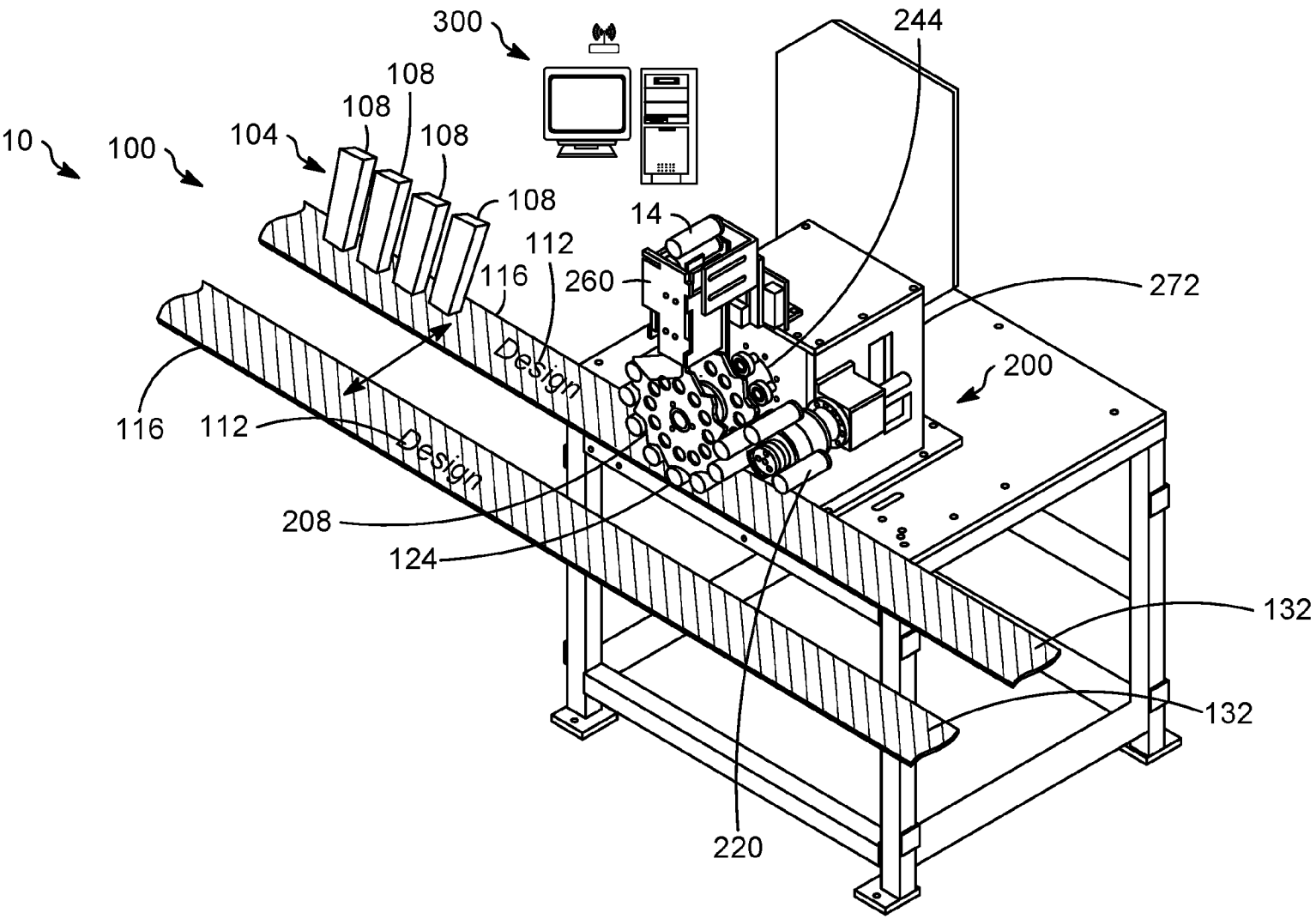
FIG. 18 is an alternative table top beverage can decoration apparatus employing a pair of endless image transfer belts in parallel and a movable inker unit movable back and forth between the two belts, a mirror image handling module has been removed for simplicity of illustration.

In at least one embodiment, the inker unit 104 is movable between adjacent endless image transfer belts 116 as illustrated in FIG. 18. Here, a single inker unit 104 moves laterally as shown by the two-headed arrow from a first endless image transfer belt 116 to a second endless image transfer belt 116 and back again.

Beverage Container Body Handling Modules

Several beverage container handling modules 200 are shown in the figures. Each beverage container handling module 200 comprises at least one impression roll 204. The impression rolls 204 are inserted within the open ends 26 of the beverage container bodies 14 and provide a support against which the printing, or image transfer, from the image transfer belt 116 takes place. Preferably, the impression rolls 204 do not engage the printing surface 132 of the image transfer belt 116 during printing of the beverage container body sidewall 18 at the printing site 124. Stated another way, the impression rolls 204 do not contact the image transfer belt 116 during operation of the decorator 10. The decorators 10 are configured such that the beverage container body sidewalls 18 engage the printing surface 132 of the image transfer belt in the absence of engagement of the impression rolls 204 with the image transfer belt 116 (see FIG. 22).

Referring specifically to the embodiment illustrate in FIGS. 1-4, a high-speed decorator 10 incorporating a beverage container handling module 200 is illustrated. This beverage container body handling module 200 is capable of continuously delivering beverage container bodies 14 to a printing site 124 without interruption.

Here, undecorated beverage container bodies 14 are delivered to pockets 208 located at the periphery of a rotational indexer 212. Generally horizontal impression rolls 204 are also mounted to the indexer 212. Each impression roll 204 is in angular alignment with a pocket 208, but axially offset therefrom. The undecorated beverage container bodies 14 are mechanically transferred from the pockets 208 to the impression rolls 204 as the container body bottoms 22 engage a tapered or angled surface which urges the open end 26 of the container bodies 14 onto the impression rolls 204. The beverage container bodies 14 are decorated while mounted on the impression rolls 204 as the beverage container bodies 14 are delivered to the printing site 124 by the impression rolls 204 and brought into engagement with the continuously rotating image transfer belt 116. Thereafter, and while still mounted to impression rolls 204, decorated beverage container bodies 14 may have a protective film of varnish applied thereto by engagement with an applicator roll in an overvarnish unit 216.

The decorated beverage container bodies 14 are transferred from the impression rolls 204 to retainers, such as vacuum chucks 244, mounted to a transfer turret 220. The beverage container bodies 14 are then deposited on generally horizontal pins carried by chain-type output conveyor 224 which transfers the decorated beverage container bodies 14 to and through a curing process, such as a curing oven or ultrasonic curing station.

Figure 5:
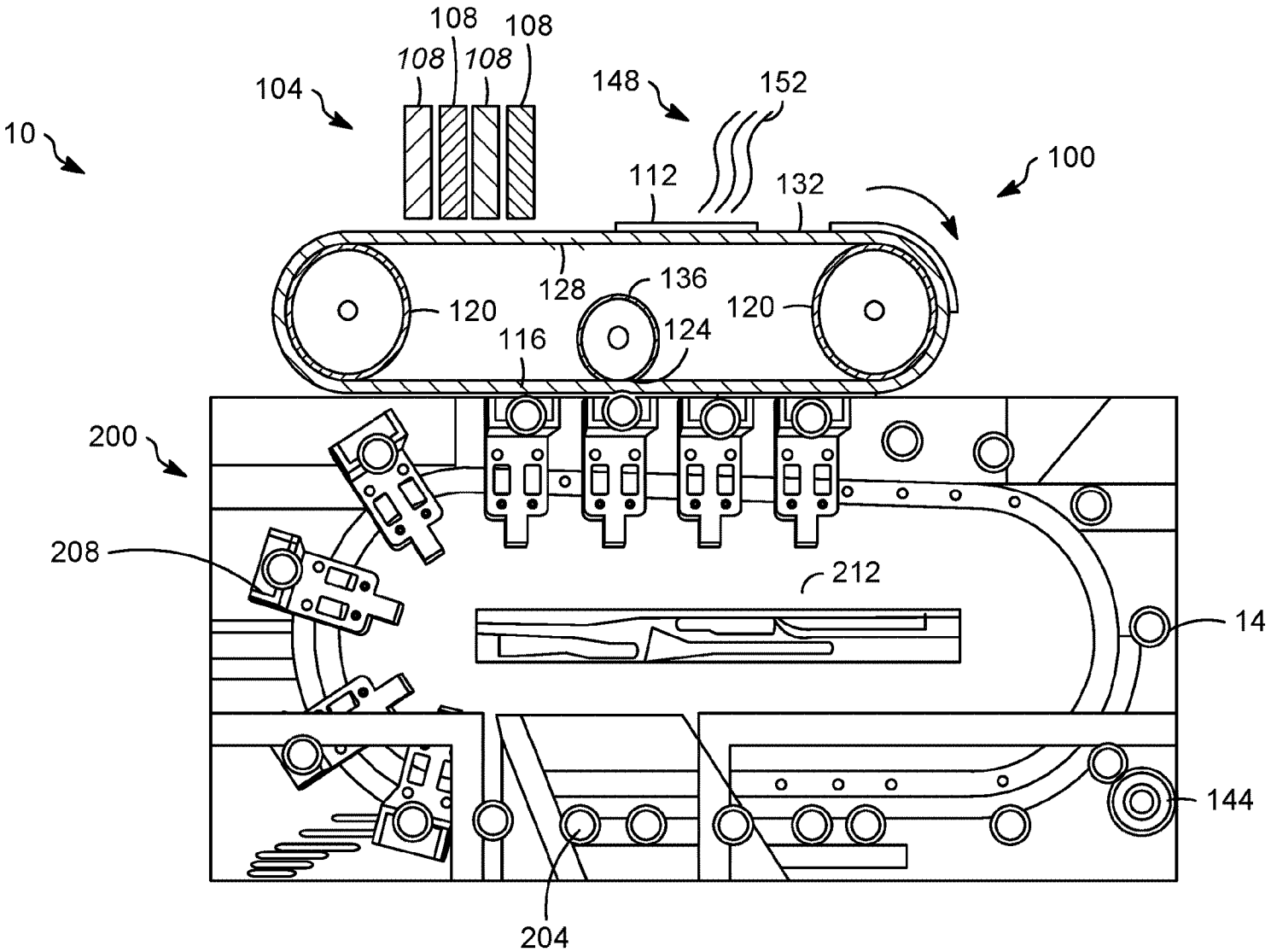
FIG. 5 is side view of an embodiment of the present invention employing a single printing site along a circumference of an endless image transfer belt and a beverage container body handling module comprising a means for transferring multiple impression rolls one-by-one to the printing site continuously and without interruption.

In FIG. 5, an alternative beverage container body handling module 200 is illustrated. Like the previous example, beverage container bodies 14 are loaded onto a plurality of impression rolls 204, which are then transported to a printing site 124 where image transfer takes place.

Figure 6:
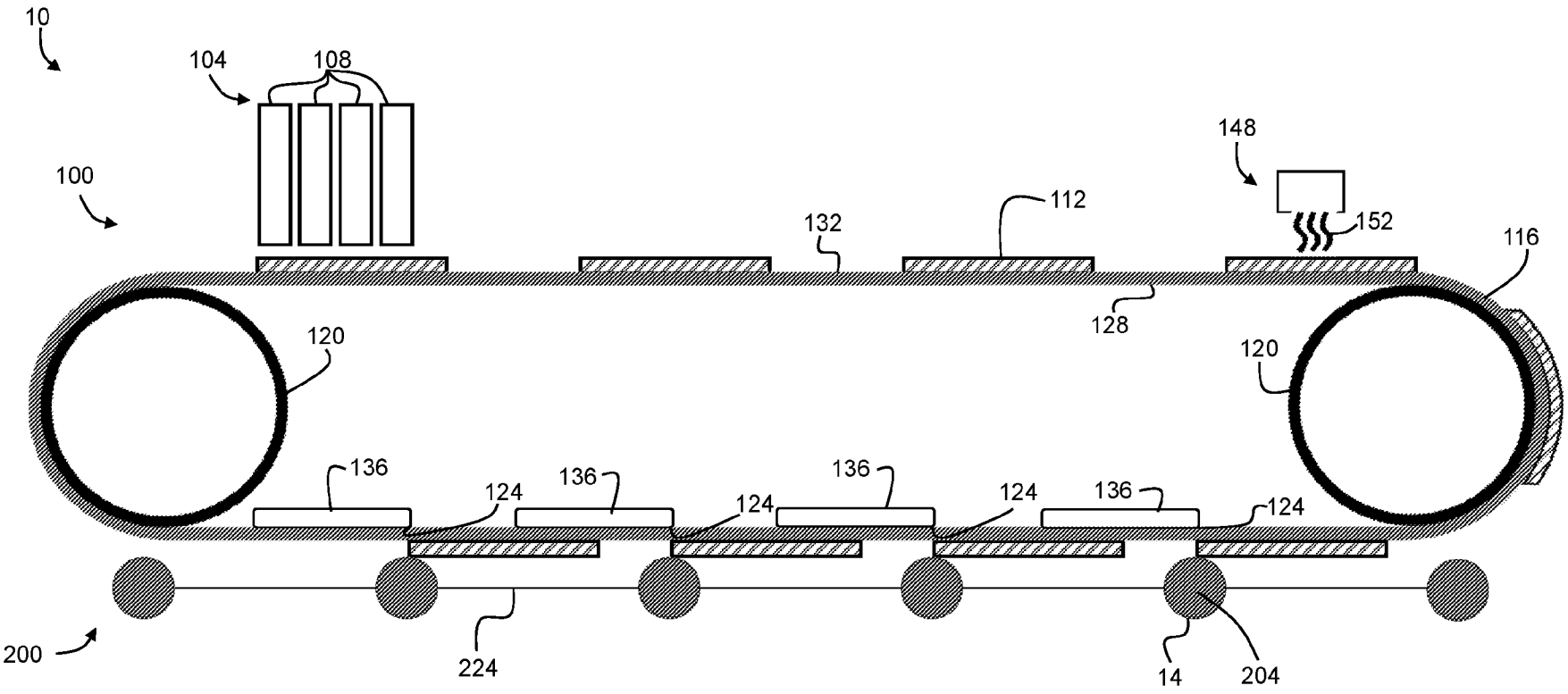
FIG. 6 is an embodiment of the invention featuring multiple printing sites on a single printing module and a single beverage container body handling module with a chain driven beverage container handling module.

In FIG. 6, an alternative beverage container handling module 200 includes a chain 224 on which a multiple impression rolls 204 are attached and brought into alignment with multiple printing sites, each incorporating a pressure member 136. This embodiment allows multiple beverage container bodies 14 to be decorated simultaneously. In the example illustrated, 4 beverage container bodies 14 are simultaneously decorated.

Figure 7:
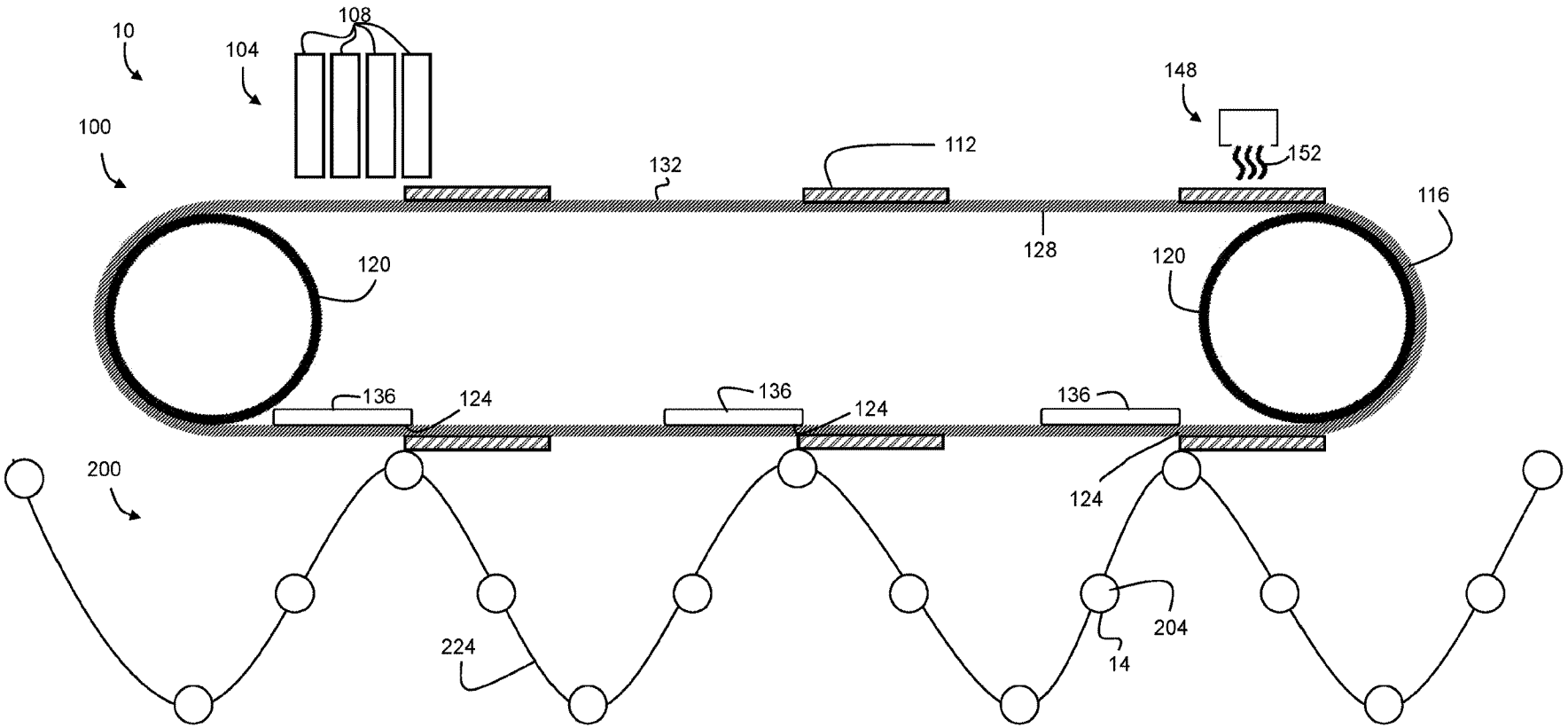
FIG. 7 is an embodiment of the featuring multiple printing sites on a single printing module and a single beverage container body handling module with a serpentine chain driven beverage container handling module.

In FIG. 7, an alternative beverage container handling module 200 includes a chain 224 on which multiple impression rolls 204 are attached and brought into alignment with a plurality of printing sites 124, each incorporating a pressure member 136. In this embodiment, the chain 224 follows a serpentine path. This embodiment also allows multiple beverage container bodies 14 to be decorated simultaneously. In the example illustrated, 3 beverage container bodies 14 are simultaneously decorated.

Figure 8:
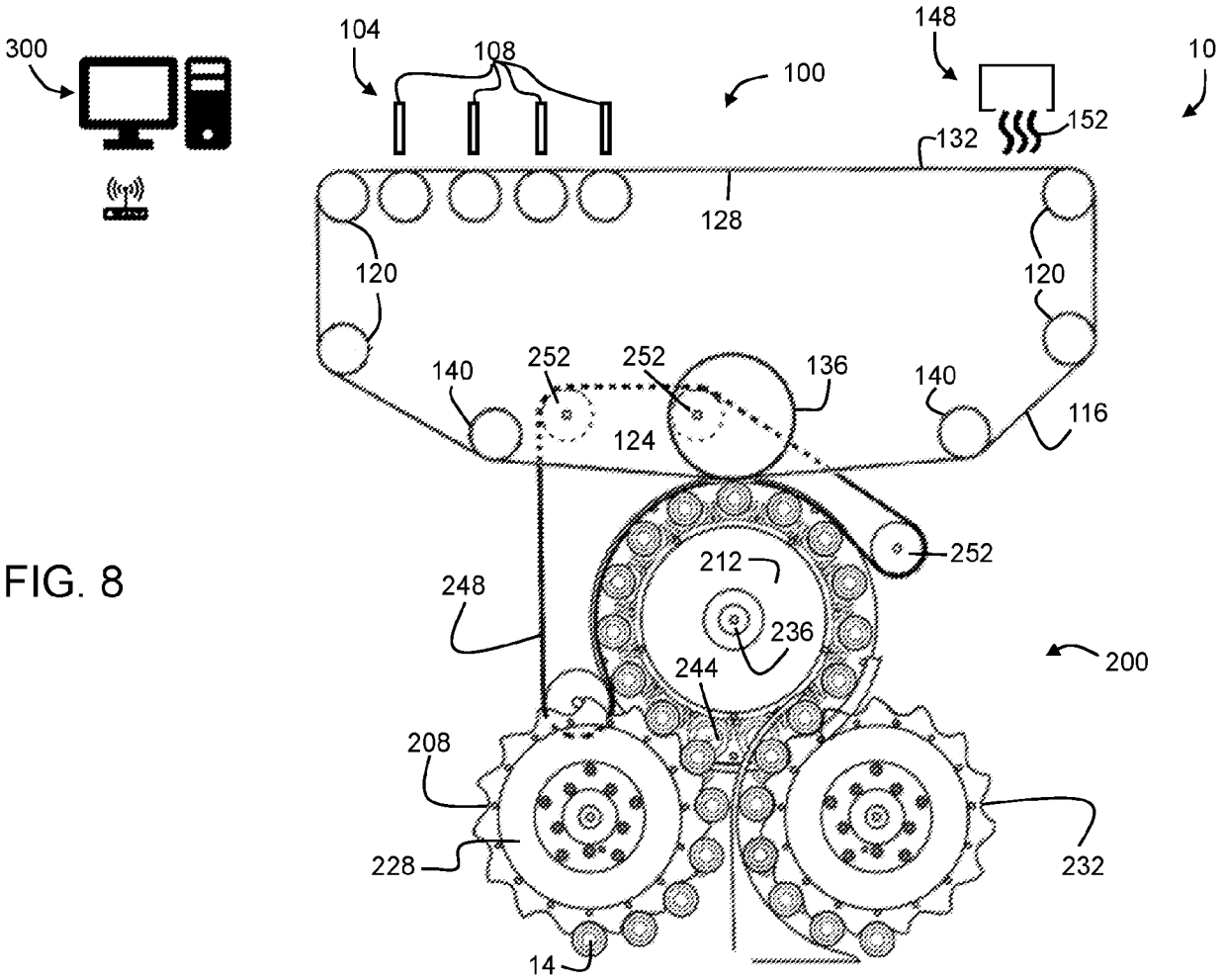
FIG. 8 is an embodiment of the invention showing a beverage can handling module featuring a rotary indexer and transfer wheels for delivering beverage container bodies to and from the indexer.
Figure 9:
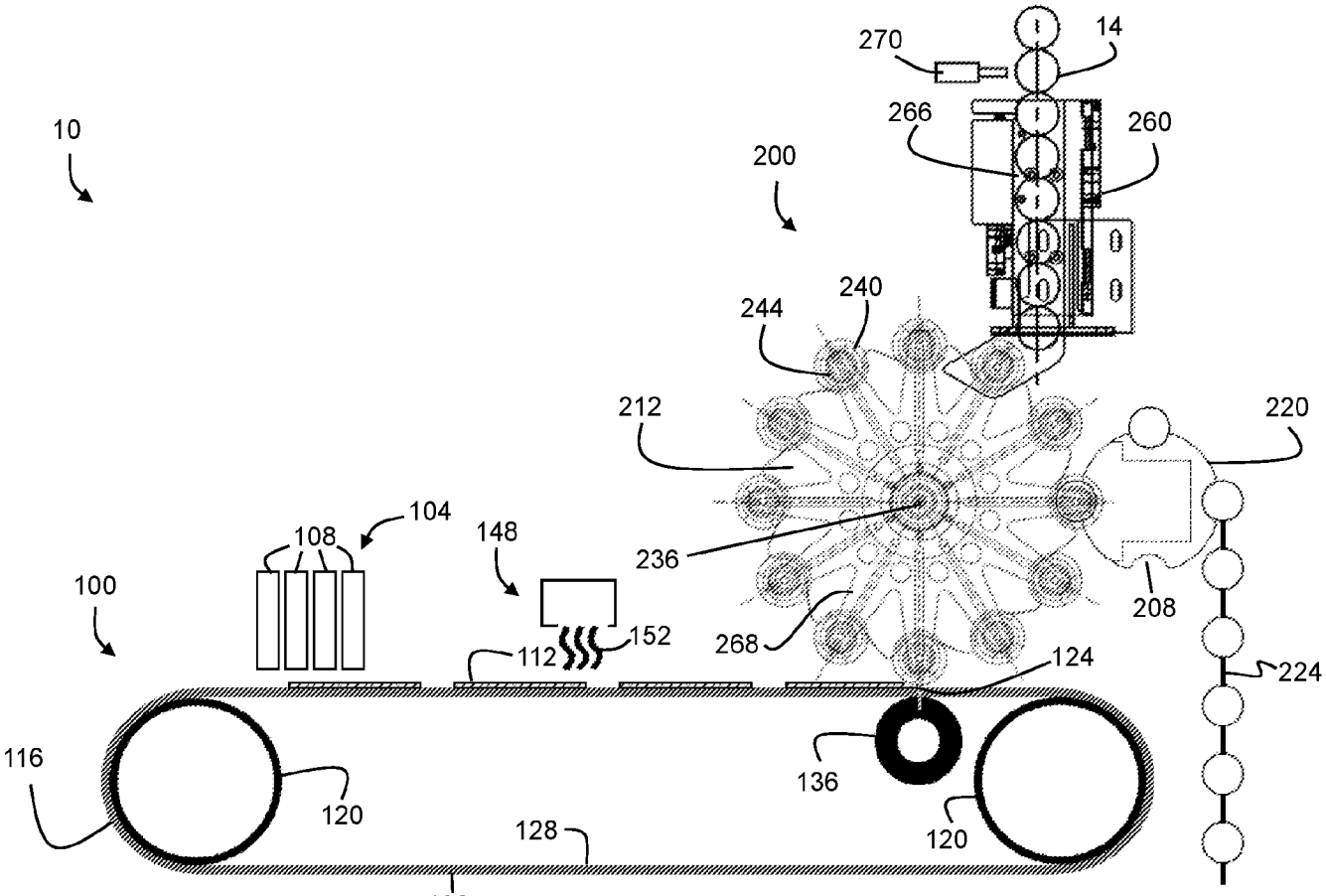
FIG. 9 is an embodiment of the invention showing a rotary beverage can handling module.
Figure 10:
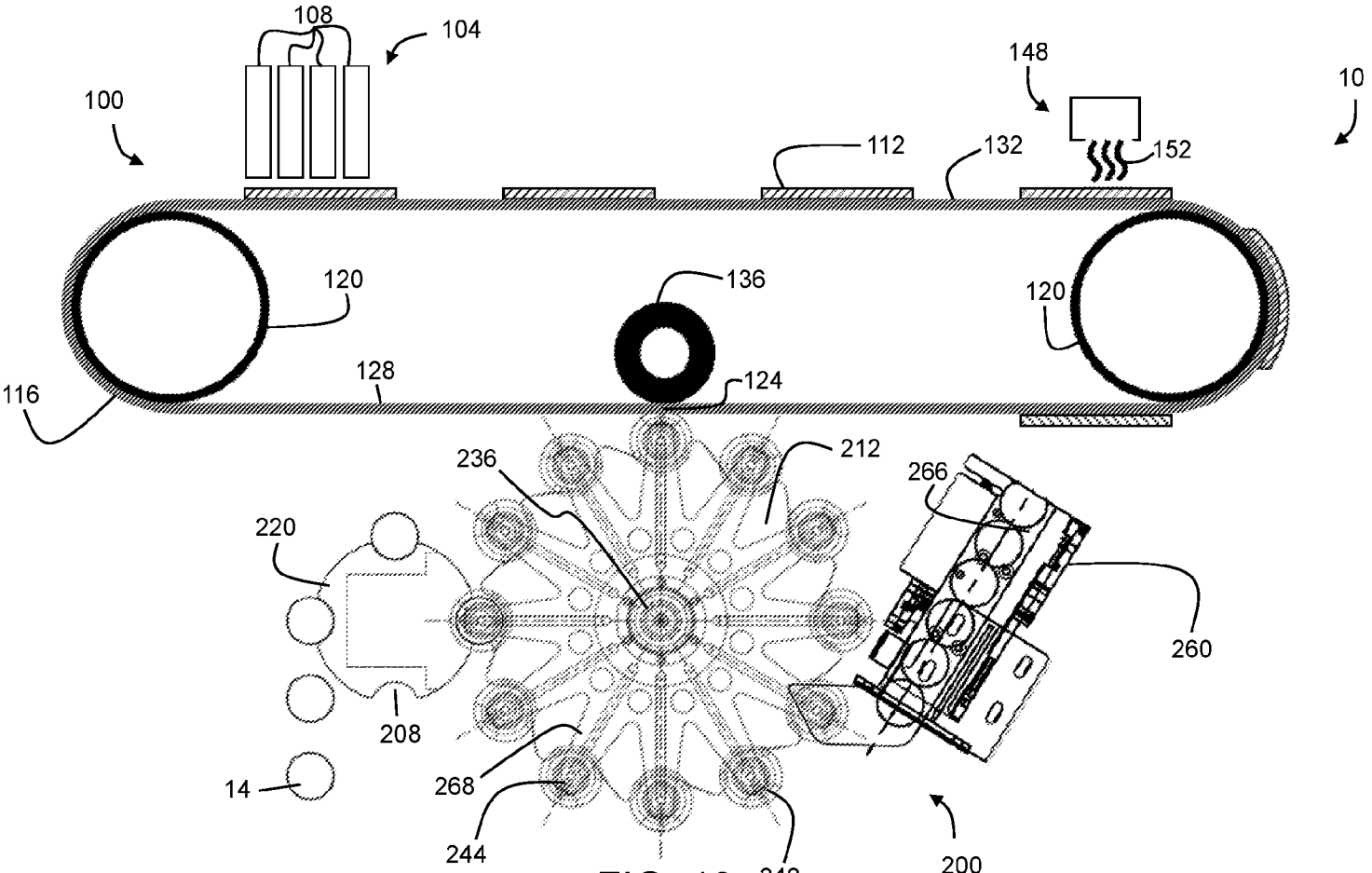
FIG. 10 is an embodiment of the invention showing a rotary beverage can handling module.

In FIG. 8, the beverage container handling module 200 includes an indexer 212 for accepting the beverage container bodies 14 from a first transfer wheel or rotary delivery turret 228 and sequentially transferring the beverage container bodies along an indexed path comprising a plurality of dwell positions to a second transfer wheel or rotary delivery turret 232 and delivery from the beverage container handling module 200 to an exit conveyor or pin chain 224 (not shown).

The indexer 212 is circumferential and rotates about a central hub 236. It has a plurality of pockets 208 adapted, as in sized and shaped, to support, control, and properly orient the sidewall 18 of the beverage container body 14 and to prevent misalignment of the beverage container body 14 through the decoration process. Each pocket 208 has a turntable 240 associated therewith, preferably a rotatable vacuum chuck 244 which utilizes a vacuum pressure to maintain the beverage container bodies 14 in position as the indexer 212 indexes or transports the beverage container bodies 14 through the decoration process as described above. Thus, the vacuum chucks 244 are each in fluid communication with a source of fluid pressure. The vacuum pressure is used to attach each beverage container body 14 to the turntables 240. The vacuum chucks 244 are rotatable about an axis that is at least a substantially horizontal axis, preferably a horizontal axis. The rotation of the vacuum chuck imparts a similar rotation to the beverage container body 14. The vacuum chucks 244 further may include a chuck nose that fits within a bottom domed portion of the beverage container body 14 to further support the beverage container body 14 through the decoration process.

The vacuum chucks 244 can be directly driven by motors or belt-driven. This enables a spinner belt 248 wound around a plurality of idler pulleys 252 to impart rotational movement to the beverage container bodies 14 attached to the vacuum chucks 244. The idler pulleys 252 are operably joined to a spinner motor which in turn drives the spinner belt 248. The spinner motor may be an AC motor.

An encoder may be used to track rotational movement of the indexer 212 and the turntables 240 and communicate the information to a computer for positional control. It communicates by taking the angular velocity of the pulley shaft and converting the information to digital data for use by the computer. There may be two encoders, one for the indexer 212 and one of the turntable 240 information.

As shown, the vacuum chucks 244 are driven by the spinner belt 248, achieving an identical angular rotation. One advantage of this spinner belt 248 system allows the beverage container bodies 14 to be stationary (i.e. not spinning) at infeed and discharge. Because they are not spinning, a vacuum can be used to pick up the beverage container body 14. The angular rotation remains constant between the vacuum chucks 244, which reduces potential beverage container body 14 damage.

This decorator 10 may run (i.e. decorate) at 300 beverage container bodies 14 per minute or more. This is based on the combined move time and dwell time required by the process. As the move time and the dwell time are reduced, throughput is increased. However, it is contemplated that this embodiment is capable of decorating 400 to 600 beverage container bodies 14 per minute. Adding additional beverage container handling modules 200 to the printing module 100 improves throughput to 1000 to 2000 beverage container bodies 14 per minute. A servo motor is used to control dwell and index time. Thus, the speed of the index and output of the software can be increased with less decoration. In other words, the rate of decoration of beverage container bodies 14 can be varied depending on the complexity of the ink 112 pattern and finished design.

A programmable controller which may be included with the computer system 300 is in communication with decorator 10, the one or more servo motors which drive the indexer 212 and the transfer wheels 228, 232. It can be used to program the indexer 212 to any predetermined dwell time independent of the speed of the upstream and downstream processes to ensure a continuous processing of beverage container bodies 14 through the decorator 10. Thus, the decorator 10 can be programmed based on time without mechanical intervention.

The decorator 10 is programmable, and any number of dwell time preferences can be achieved on the same decorator 10 without the need for mechanical changes to the decorator 10.

Figure 19:
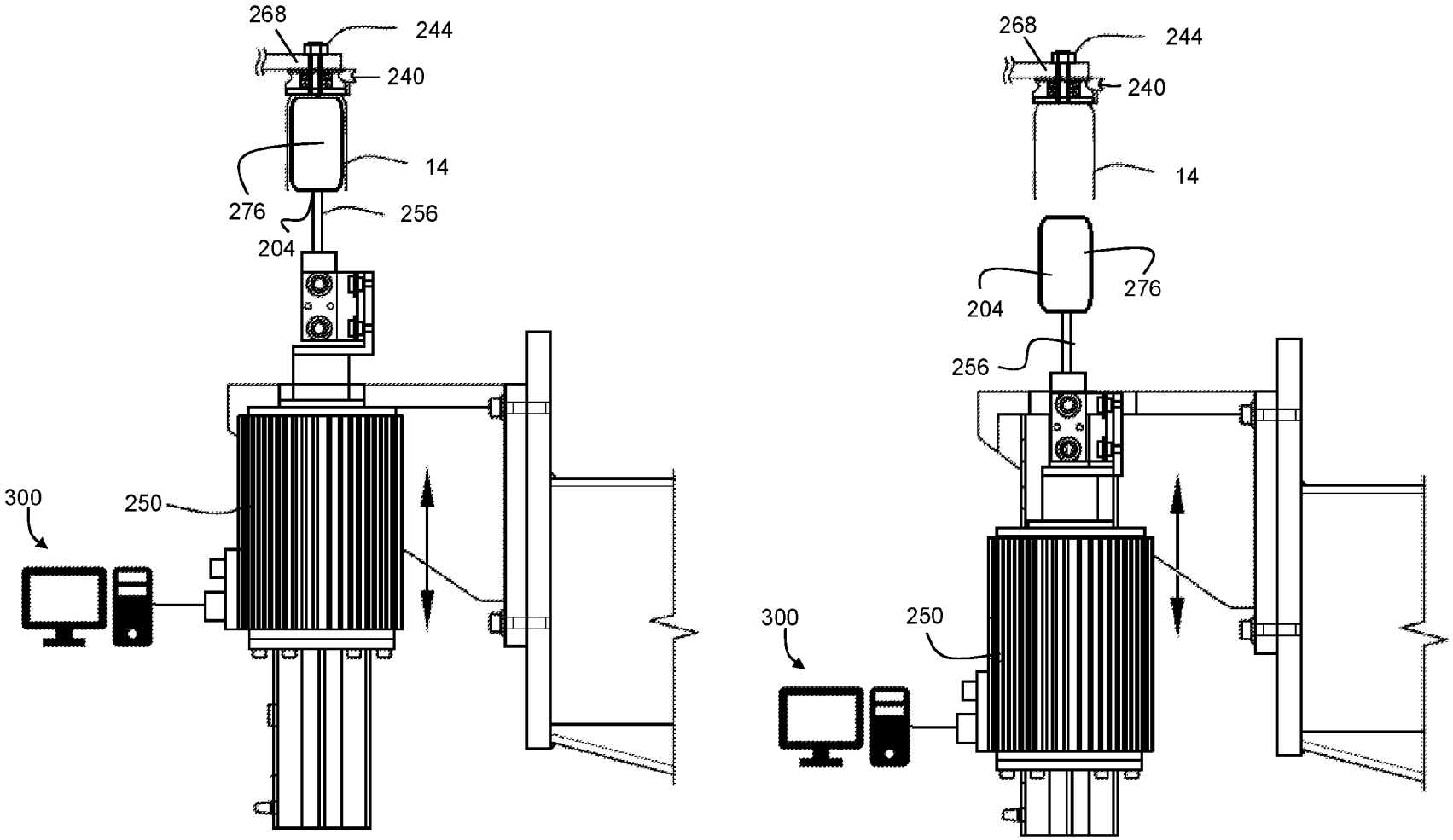
FIG. 19 is a top view of an arrangement for transferring an impression roll into and out of a beverage container body at a printing site which can be used in combination with the beverage container body handling modules illustrated in FIGS. 10-18.
Figure 23:
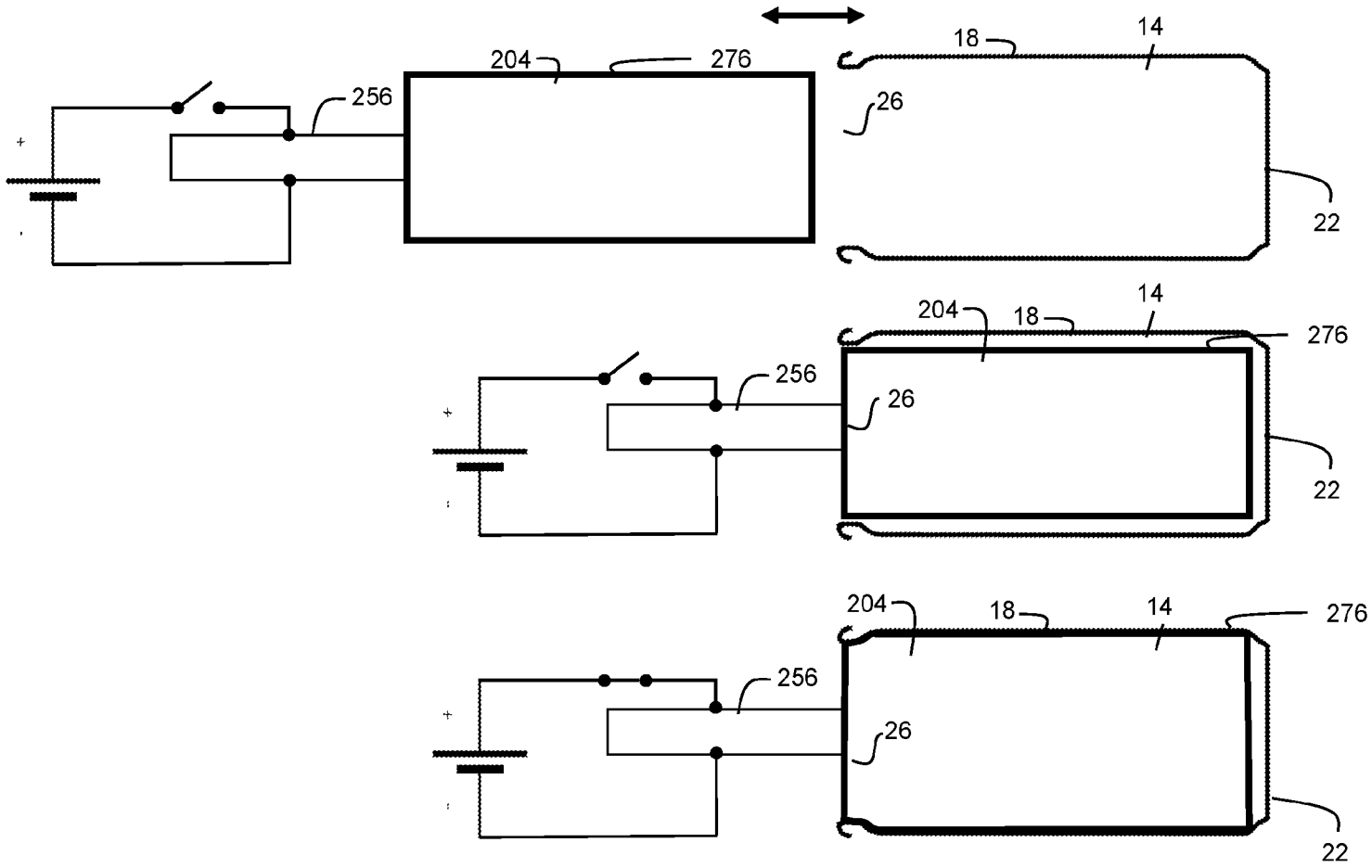
FIG. 23 is a side view of an impression roll of an electroactive polymer being inserted into and energized within a necked and flanged container body.

An impression roll 204 may be inserted into the beverage container body at the printing site 124 during the dwell period during which the beverage container body 14 is printed or decorated. This may be accomplished by a relative movement between the impression roll 204 and the indexer 212 as illustrated in FIGS. 19 and 22 or by transfer of the beverage container body 14 from the indexer 212 onto the impression roll 204 as illustrated in FIGS. 20, 21, and 23. Again, the impression roll 204 within the interior of the beverage container body 14 supports the sidewall 18 of the beverage container body 14 during ink 112 transfer to the sidewall 18 of the beverage container body 14 to prevent the sidewall 18 from collapsing under the force or pressure between the pressure member 136/image transfer belt 116 and the sidewall 18.

In this embodiment, the impression roll 204 is preferably inserted within the beverage container body 14 during a dwell period when the beverage container body 14 is located at the printing site 124. The left side of FIG. 19 shows the impression roll 204 within the beverage container body 14 while the right side of FIG. 19 shows the impression roll 204 withdrawn from the beverage container body 14. The impression roll 204 can be operated by a servo 250 which extends or pushes the impression roll 204 into the beverage container body 14 and withdraws the impression roll 204 from the beverage container body 14 post-decoration.

Preferably, this embodiment includes means for providing relative movement between the indexer 212 and the impression roll 204 wherein a distance between indexer 212 and the impression roll 204 may be reduced. Preferably, at least one impression roll 204 is capable of movement relative to a beverage container body 14 adhered to the indexer 212. This movement is preferably a linear movement to traverse the impression roll 204 from a first position to a second position within the opening 26 of the beverage container body 14 where the impression roll 204 provide support for the sidewall 18 during the printing process as described above. Regardless, the movement should be perpendicular to an imaginary plane defined by the opening 26 of the beverage container body 14. Typically, this imaginary plane is a vertical plane.

Alternatively, the impression roll 204 may be inserted within the beverage container body 14 during the dwell period using pressurized air 254 as shown in FIGS. 20 and 21. At the dwell position, the beverage container body 14 is removed from the indexer 212 and loaded onto the impression roll 204 coincident with the printing site 124. A force F provided by a source fluid pressure causes the beverage container body 14 to be removed from the indexer 212 and transferred onto the impression roll 204. Thus, the force F causes a movement M by a beverage container body 14 which transfers the beverage container body 14 from the indexer 212 at the dwell position onto and over or about impression roll 204 at the printing site 124 across the horizontal offset between dwell position and the printing site 124. The image transfer belt 116 is aligned with the impression roll 204 at the printing site 124.

Figure 13:
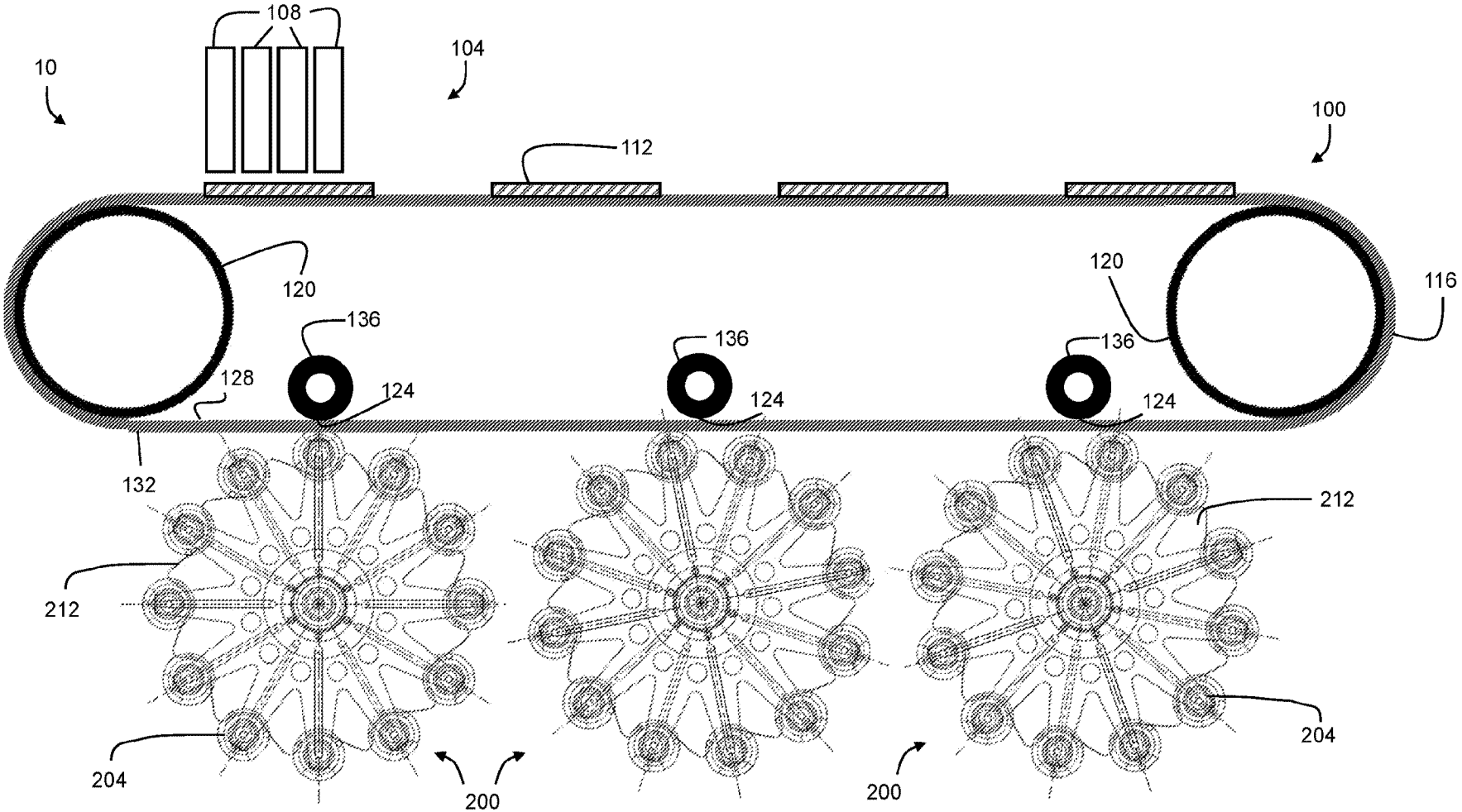
FIG. 13 is an embodiment of the invention showing multiple printing sites employing a single printing module and multiple rotary beverage container handling modules wherein a first beverage container handling module has an impression roll located at a first printing site, a second beverage container handling module has an impression roll offset (i.e. not located at) from a second printing site, and a third beverage container handling module has an impression roll offset (i.e. not located at) from a third printing site.
Figure 14:
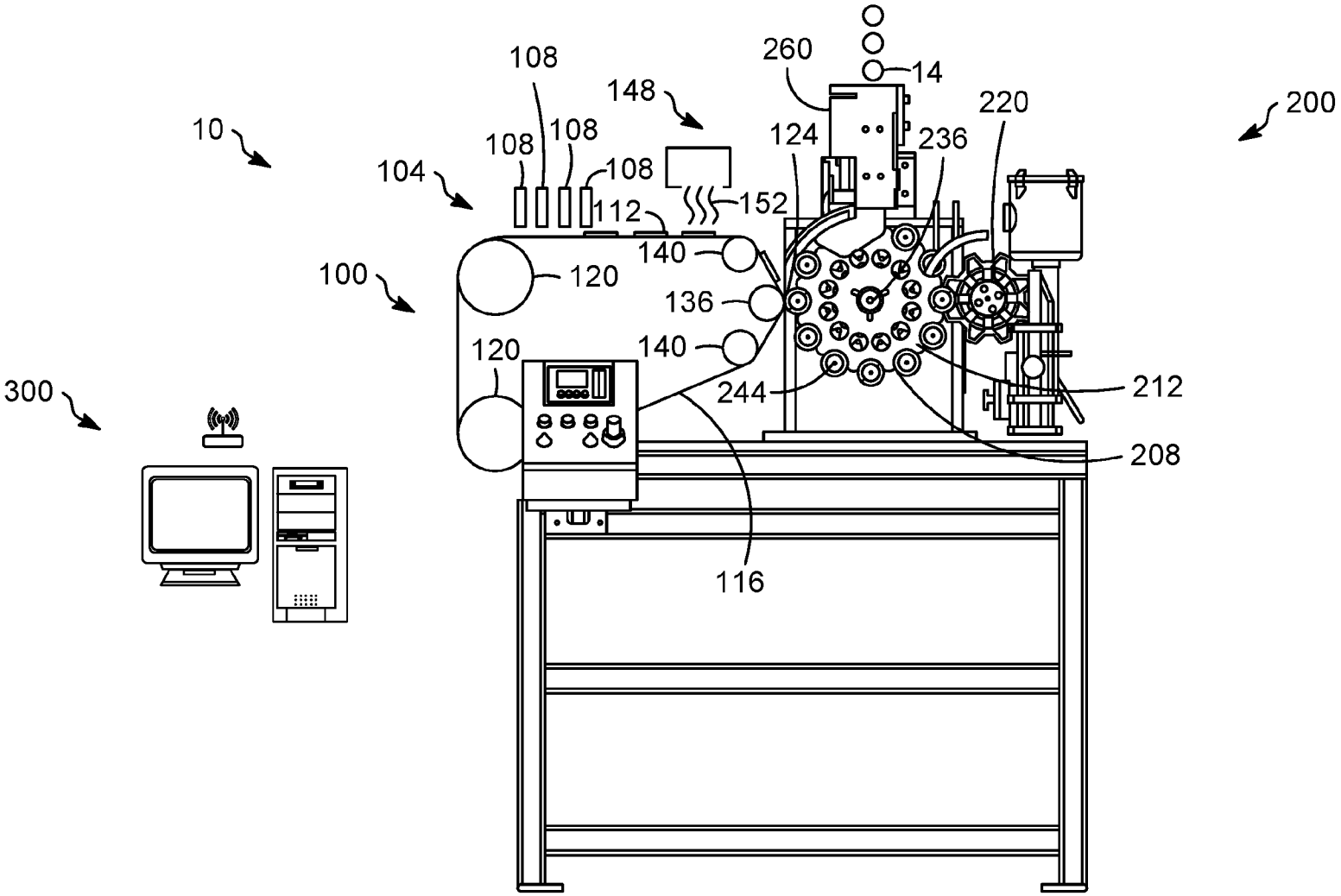
FIG. 14 is a table top beverage can decoration apparatus employing a single image transfer belt and a rotary beverage container handling module.
Figure 15:
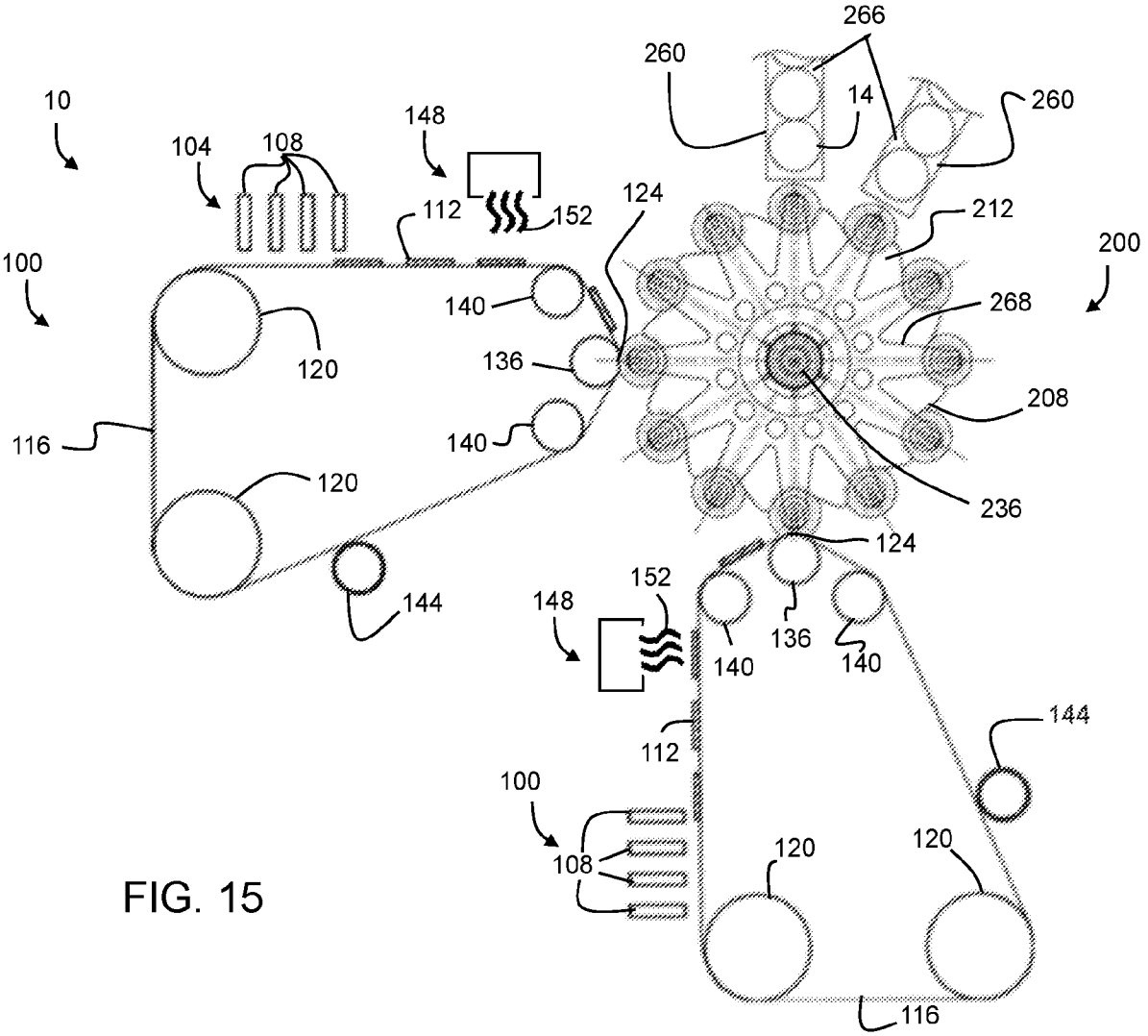
FIG. 15 is a table top beverage can decoration apparatus employing multiple printing module and a single beverage container handling module.

Again, movement by the impression roll 204 can be accomplished by operably connecting or coupling the impression roll 204 to one or more servo motors 250. Preferably, each impression roll 204, if there is more than one printing site 124, see, for example, FIGS. 13 and 15, is coupled to a separate servo motor 250 such that each impression roll 204 is capable of movement independent of the other impression roll 204. The impression rolls 204 are attached to guide shafts 256 controlled, preferably directly controlled, by its corresponding servo 250. These servo motors 250 may also be used to impart rotation to the impression rolls 204 which transfer rotation to the beverage container bodies 14 during the printing operation. Alternatively, the impression rolls 204 can be freewheeling and rotation of the beverage container bodies 14 can be achieved through engagement with the image transfer belt 116.

Furthermore, the controller can synchronize a rotation of the indexer 212 with printing module 100. It generally follows that the programmable controller, which may be housed on the computer system 300, can be used to control the timing of not only the decorator 10 but also printing module 100 to ensure a smooth flow and processing of beverage container bodies 14 without unnecessarily long dwell times wherein beverage container bodies 14 rest without being decorated.

A unique problem is associated with decoration of beverage container bodies 14 that have undergone necking and flanging to reduce the opening in the open end 26 of the beverage container body 14 and ready it for filling and closing with a can end or lid by a double seaming operation. In these cases, the impression roll 204 diameter must be small enough to fit with the down-sized opening. Unfortunately, when the opening is reduced, and the impression roll 204 diameter is reduced to fit within the interior space of the beverage container body 14, the impression roll 204 is no longer large enough to provide its function of supporting the sidewall 18 during printing. FIGS. 22 and 23 illustrate an expandable impression roll 204 using the technology discussed relative to the embodiments of FIGS. 19 and 20-21, respectively, to overcome this drawback. The impression roll 204 may be expandable by a fluid pressure or the like but is preferable at least partially constructed from an electroactive polymer that changes dimension when stimulated by an electric field.

For example, as illustrated in FIGS. 23 and 24, relative movement between the impression roll 204 and the beverage container body 14 locates the impression roll 204 within an interior space of the necked and flanged beverage container body 14. When a voltage is applied from a source of voltage, the impression roll 204 diameter expands to engage and support a circumferential an inner surface of the interior space of the beverage container body 14. When the voltage is removed, the impression roll 204 returns to its original state, and the impression roll 204 can be removed from the beverage container body 14.

Now referring to the embodiments illustrated in FIGS. 9-18, these embodiments include one or more gravitational feeders 260, an indexer 212, and a transfer turret 220.

Figure 16:
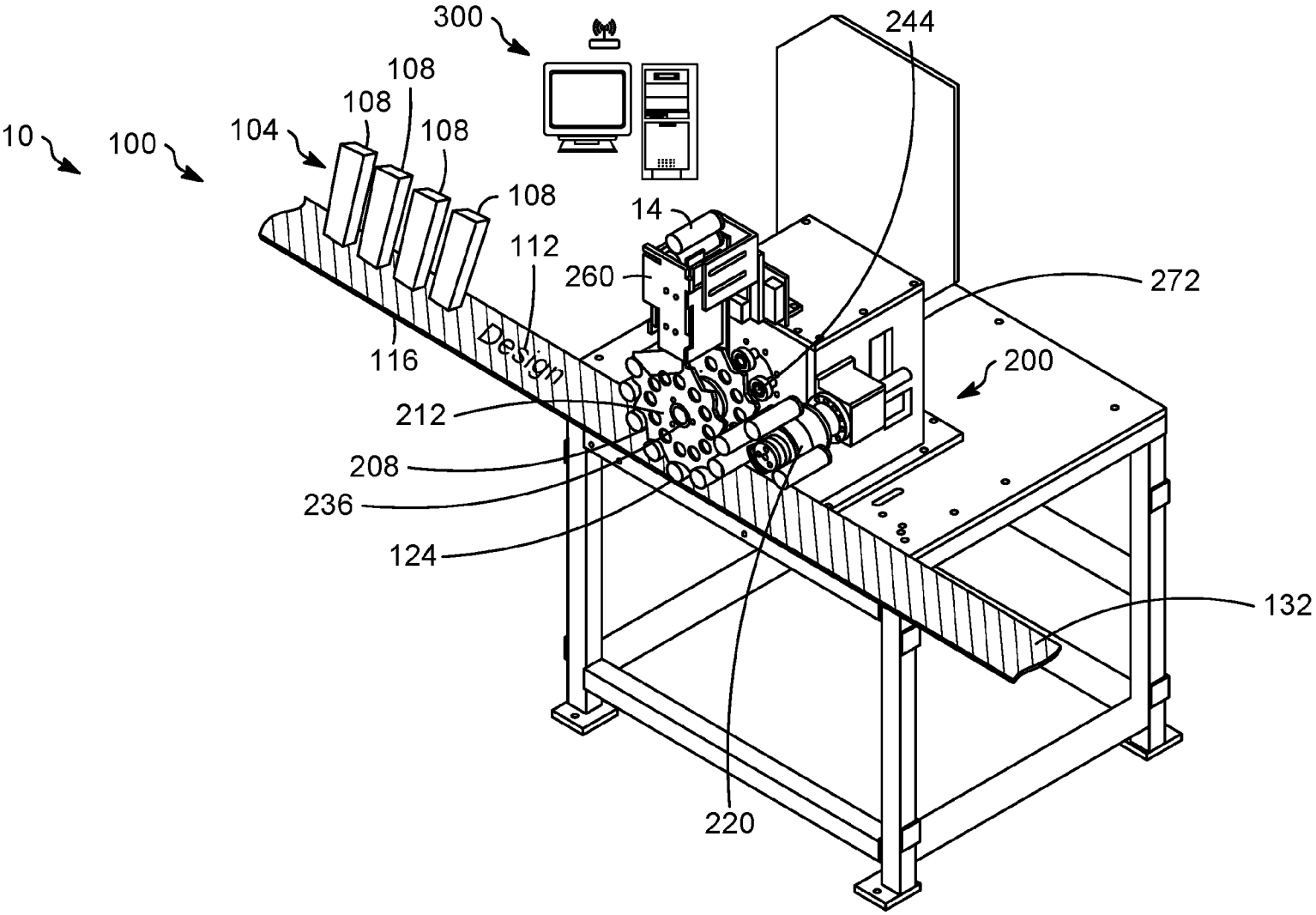
FIG. 16 is an alternative table top beverage can decoration apparatus employing a single printing module and a single beverage container body handling module.

Further to the feeder 260, beverage container bodies 14 enter the decorator via the feeder 260. Gravity acts to transfer the beverage container bodies, one-by-one, through an entry chute 266, which delivers the beverage container bodies 14 to the indexer 212. This in-feed assembly allows for proper flow of the beverage container bodies 14 into the decorator 10. In some embodiments (see, e.g., FIGS. 13 and 15), multiple feeders 260 are provided. In the embodiment of FIG. 13, a feeder 260 (not shown for simplicity) would be associated with each indexer 212. In the embodiment of FIG. 16, two feeders 260 transfer beverage container bodies 14 to separate points along the indexer 212 as will be described in more detail below.

The indexer 212 sequentially transfers a plurality of beverage container bodies 14 along a predetermined fixed path through the decorating operation, to and through the printing site. The indexer 212 includes a star-shaped member having a plurality of legs 268 radiating outwardly from a hub 236. Any number of legs 268 can be provided as feasibly possible.

These decorators 10 employ a first servo drive motor 272 (see, e.g., FIGS. 16 and 17) which drives the indexer 212 to rotated about a central hub 236. The first servo motor 272 can be used to establish a dwell time, wherein the beverage container bodies 14 are stationary relative to the central hub 236 for a moment during which the ink 112 is transferred from the image transfer belt 116 to the beverage container sidewall 18. As the speed of the rotation of the indexer 212 is increased the dwell time decreases.

The first servo motor 272 is further coupled to the transfer turret(s) 220 to provide synchronized rotational movement to the transfer turret 220 with the indexer 212.

The decorator 10 includes a computer 300 having a memory with a software stored thereon. The computer 300 acts as an external programmable controller which is in communication with printing module(s) 100 and the beverage container body handling modules(s) 200. Thus, the computer 300 can be used to program and control the first servo motor 272 to any predetermined dwell time independent of the speed of the indexer 212, which may also be controlled by the computer 300, by sending a signal thereto.

In the decorators 10 illustrated, there are twelve (12) legs 268 forming a 30-degree index. However, the inventors contemplate that the apparatuses disclosed herein may be provided with a 30-degree index, a 60-degree index, or any other degree index without departing from the scope of the invention. In other words, one indexer 212 as contemplated herein comprises a plurality of equally spaced index positions about a circumference of a rotational indexer 212.

At a terminal end of each leg 268, the indexer 212 has a vacuum chuck 244. The vacuum chucks 244 utilize a vacuum pressure to maintain the beverage container bodies in position as the indexer 212 indexes the beverage container bodies through the printing process. Thus, the vacuum chucks 244 are each in fluid communication with a source of fluid pressure. The vacuum pressure is used to attach each beverage container body to the indexer 212.

The vacuum chucks 244 are substantially free-wheeling. This enables a spinner belt 248 wound around a plurality of idler pulleys 252 to impart rotational movement to the beverage container bodies 14 attached to the vacuum chucks 244 if so desired. One of the idler pulleys 252 is operably joined to a spinner motor which in turn drives the spinner belt 248. One or more spinner gears may be provided to control the revolutions per minute of the beverage container bodies 14.

Each vacuum chuck 244 may be outfitted with a flag. As each chuck moves into a dwell position, the chuck pauses in front of a sensor. The sensor counts the number of times the flag passes and compares it against a preset count to insure the beverage container body 14 undergoes the proper number of revolutions.

The transfer turret 220 receives decorated beverage container bodies 14 from the indexer 212. This transfer typically occurs at the 270-degree index position in a counterclockwise cycle by the indexer 212, or the 3 o'clock position using a time clock reference. The transfer turret 220 transports decorated or adorned beverage container bodies 14 in a clockwise rotation to a pin chain 224. Beverage container bodies 14 exiting the decorator 10 via the transfer turret 220 are sent for further processing, packaging and delivery, filling, etc.

Like the embodiment of FIG. 8, the embodiments of FIGS. 9-17 include a means to locate an impression roll 204 within an interior of the beverage container body 14 during printing or decorating. This may include a means for relative movement between one or more impression rolls 204 and one or more printing sites rolls as illustrated in FIG. 18 or causing the beverage container body 14 to move with a fluid pressure as illustrated in FIGS. 20, 21 and 23.

As illustrated in FIGS. 13 and 15, multiple printing sites 124 can be incorporated using beverage container body handling module 200 described above. In FIG. 13, multiple beverage container handling modules 200 are incorporated with a single printing module 100 comprising an image transfer belt 116. In FIG. 13, much of the detail of the beverage container handling modules 200 has been removed for simplicity. In FIG. 15, multiple printing modules 100 are supplied with a single beverage container handling module 200.

Referring specifically to the embodiment illustrated in FIG. 13, three beverage container handling modules 200 are provided with a single image transfer belt 116. Each beverage container handling module 200 includes an indexer 212. Rotation of the indexers 212 is synchronized such that only one impression roll from one of the indexers 212 is positioned at a printing site 124 at a time. Once the impression roll 204 on a first indexer 212 rotates out of its printing site 124, an impression roll 204 on a second indexer 212 rotates into position at a printing site 124. Once the impression roll 204 on the second indexer 212 rotates out of its printing site 124, an impression roll 204 on a third indexer 212 rotates into position at a printing site 124. Once the impression roll 204 on the third indexer 212 rotates out of its printing site 124, an impression roll 204 on the first indexer 212 rotates into position at its printing site 124. This structure and method maintains continuous processing/decorating of container bodies 14 and quiets (i.e. reduces vibration, twisting, and other unwanted movements) the image transfer belt 116 during printing/ink image transfer to the container bodies 14.

Thus, it follows that an embodiment of the invention comprises a first and a second container body handling module 200. Each container body handling module 200 comprises a rotational indexer 212 configured to sequentially transport a plurality of container bodies to and from a respective printing site 124 of first and second printing sites 124. A plurality of impression rolls 204 is located about the rotational indexer 212 wherein the rotation indexer 212 rotates each impression roll 204 to its respective printing site 124 one at a time. A first impression roll 204 on the first indexer 212 rotates out of the first printing site 124 as a second impression roll 204 on the second indexer 212 rotates into position at the second printing site 124 simultaneously. None of the plurality of impression rolls 204 of the first indexer 212 are located at the first printing site 124 when any of the plurality of impression rolls 204 of the second indexer 212 is located at the second printing site 124. Likewise, none of the plurality of impression rolls 204 of the second indexer 212 are located at the second printing site 124 when any of the plurality of impression rolls 204 of the first indexer 212 is located at the first printing site 124.

Referring specifically to the embodiment illustrated in FIG. 15, one advantage of a 12-legged indexer 212 is that it may be used to process two or more beverage container bodies 14. For example, in the embodiment illustrated, two feeders 260 are provided at the 12 and 1 o'clock positions on the indexer 212 to simultaneously feed two beverage container bodies 14 to the indexer 212 at two different positions spaced by 30 degrees. By indexing 60 degrees counterclockwise, and by locating printing sites 90 degrees apart at the 9 and 6 o'clock positions, two beverage container bodies 14 can be decorated simultaneously.

The same principle can be used to print more than two beverage container bodies 14 simultaneously. For example, feeders 260 can deliver beverage can bodies to the 11, 12, 1, and 2 o'clock positions; printing sites can be located at the 10, 9, 8, and 7 o'clock positions; 4 printing modules 100 can be similarly located to correspond with the printing site 124 locations; and the indexer 212 can index by 90-degree increments. It follows that this example would result in 4 beverage container bodies 14 being simultaneously decorated upon each 90-degree index increment and dwell.

One of ordinary skill in the art would readily grasp that the embodiment illustrated in FIG. 15 could be operated according to the principles disclosed in FIG. 13. Namely, a first printing site 124 transfers ink to a beverage container body 14 while a second printing site 124 awaits the arrival of an impression roll 204 carrying a second beverage container body 14 to the second printing site. Thus, it follows that an embodiment of the invention comprises a first and a second printing module 100 and a single container body handling module 200. The container body handling module 200 comprises a rotational indexer 212 configured to sequentially transport a plurality of container bodies to and from a first and second printing sites 124, associated with the first and second printing modules 100, respectively. A plurality of impression rolls 204 is located about the rotational indexer 212 wherein the rotation indexer 212 rotates each impression roll 204 to a printing site 124 one at a time.

Figure 17:
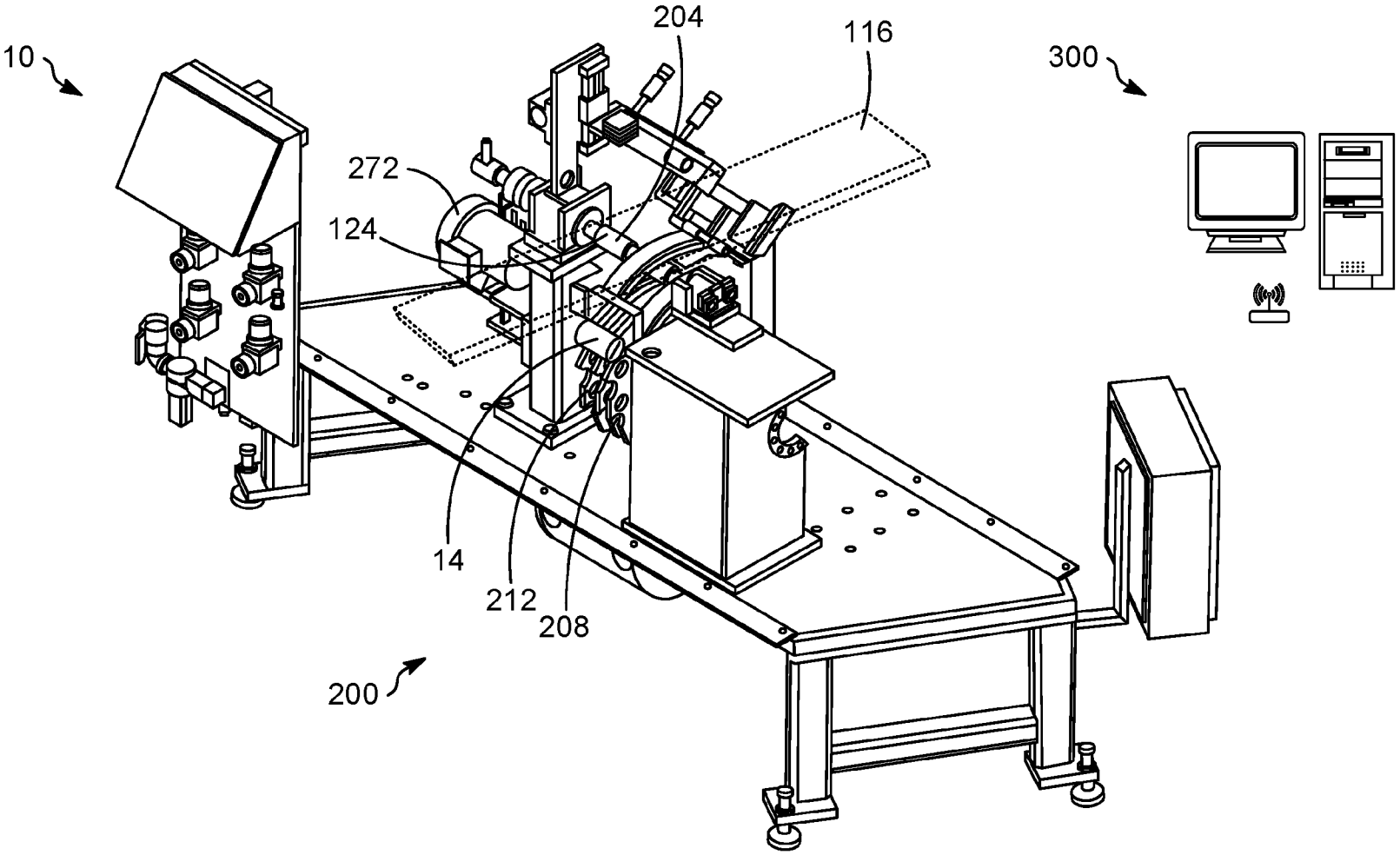
FIG. 17 is an alternative table top beverage can decoration apparatus employing a single printing module and a single beverage container body handling module.

Referring specifically to the embodiment of FIG. 17, the beverage can bodies 14 can be removed from the indexer 212 to undergo a print operation. The beverage container body 14 is loaded onto the impression roll 204 at the printing site 124. Here, the printing site 124 is spaced from the indexer 212 such that the beverage container bodies 14 must be removed from the indexer 212 from decoration and returned to the indexer 212 post-decoration. The transfer means illustrated in FIGS. 20 and 21 is particularly useful in this embodiment. Note that the pressure member 136 has been removed from FIG. 17 for clarity but would be in a location identical to previous embodiments.

Referring generally to the illustrated embodiments, it is preferable for the beverage container body 14 to rotate with rotation of the impression roll 204. The spin speed of the impression roll 204 may be variable to match the movement of the image transfer belt 116. The impression roll 204 rotation speed is variable to minimize image transfer time. It may be provided by a variable frequency drive. It could also be servo controlled, DC motor controlled, or by other means.

The impression roll 204 is similarly shaped to the beverage container bodies 14. Accordingly, it has a generally cylindrical sidewall 276 separating a distal end of the impression roll 204 from a proximal end of the impression roll 204 wherein the impression roll 204 is insertable within the beverage container bodies 14 such that the distal end is positioned adjacent an enclosed bottom of the beverage container bodies 14 and the proximal end is positioned adjacent an open end of the beverage container bodies 14. The proximal end is attached to a shaft which is joined to a motor to drive rotation of the impression roll. The impression roll 204 spins about a central, generally horizontal, axis which corresponds to a similar axis of the beverage container body 14 when it is located at the dwell position such that beverage container body transfer from the dwell position to the printing site 124 is facilitated (see FIG. 21).

The arrangement of the impression roll 204 within the interior of the beverage container body 14, of course, can be accomplished by passing the beverage container body 14 over the impression roll 204 as previously described.

The embodiment of FIG. 18 includes first and second endless image transfer belts 116 running parallel to side-by-side beverage container handling module 200. Only one beverage container module 200 is shown for simplicity. However, one of ordinary skill in the art would readily understand that a second beverage container handling module 200, identical in function to the one illustrated, can be configured to deliver beverage container bodies 14 to a second printing site 124 located directly adjacent to the printing site 124 illustrated with the impression roll systems illustrated in any of FIGS. 19-23.

Figure 11:
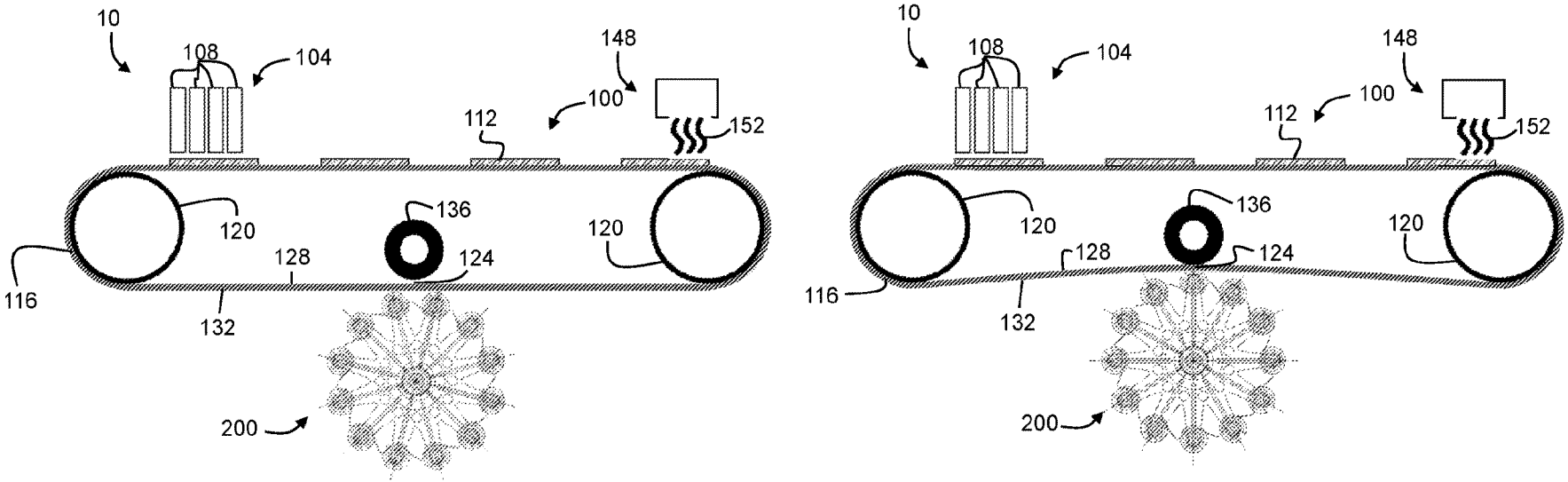
FIG. 11 is an embodiment of the invention showing a deflection in the image transfer belt.
Figure 12:
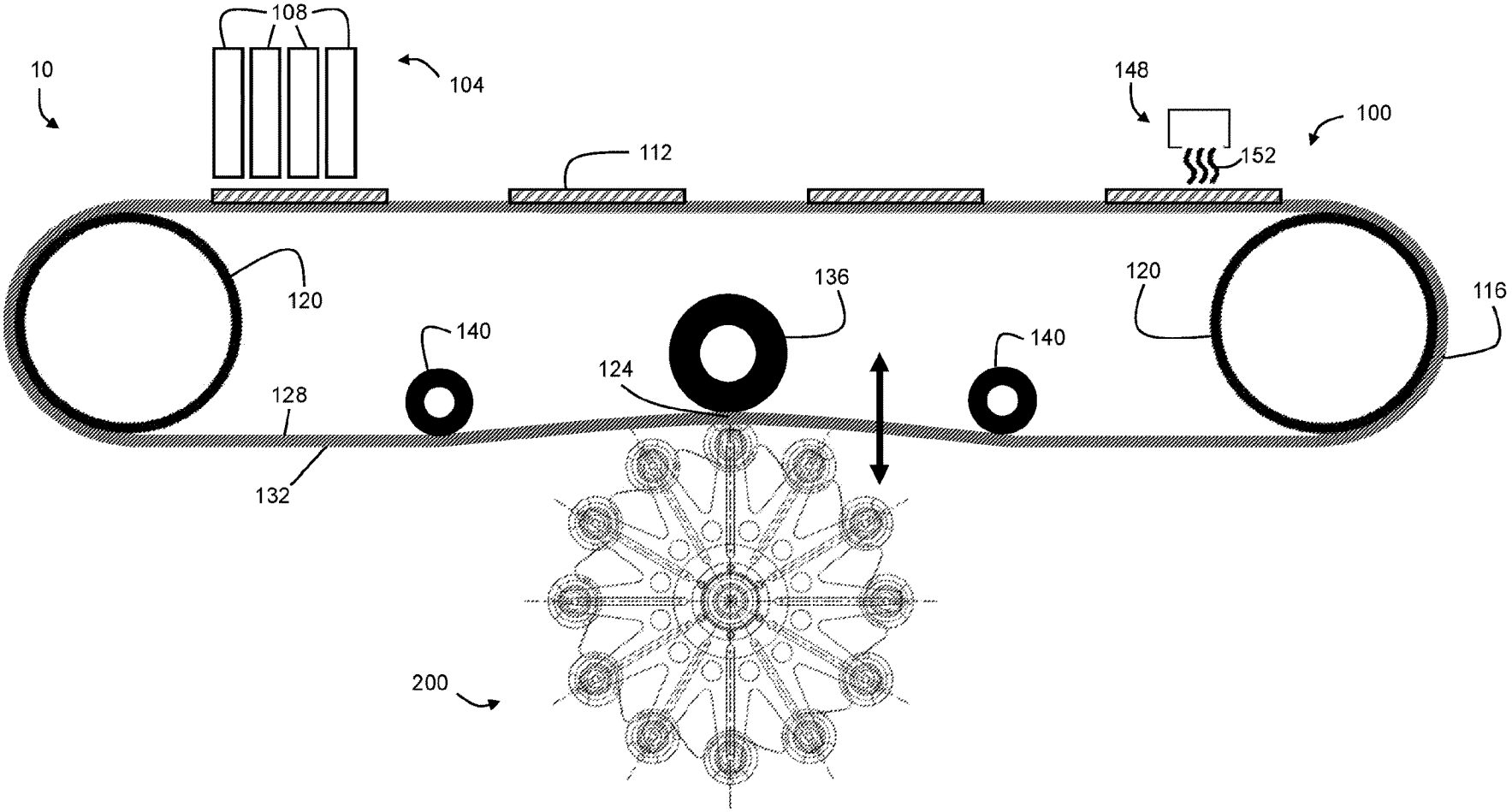
FIG. 12 is an embodiment of the invention showing a deflection in the image transfer belt.

As illustrated in FIGS. 11 and 12, engagement between the printing module 100 and the beverage container handling module 200 may cause deflection of the image transfer belt 116 at the printing site 124 during ink 112 transfer (see, e.g., two-headed arrow on FIG. 12). This deflection can be controlled by tension members 140 located on opposing sides of the pressure member 136 to limit torque or deleterious deflection of the image transfer belt during application of the ink 112 to the printing surface 132 at the inker unit 104. Here, the pressure member 136 engages the inner surface 128 only during ink 112 transfer to the beverage container body 14 at the printing site 124. Movement of the impression roll 204 to the printing site 124 causes the image transfer belt 116 to be forced or moved towards the pressure member 136 and into contact therewith. Image transfer belt 116 contact with the pressure member 136 is relieved or eliminated between print operations. Alternatively, the pressure member 136 is biased against the inner surface 128 of the image transfer belt 116 against an elastic force wherein movement of the impression roll 204 to the printing site causes deflection of the pressure member 136 overcoming the elastic biasing force and deflecting the image transfer belt 116.

The Computer System

In addition to the functions previously described, the computer system 300 includes a memory on which one or more software routines are stored. The computer 300 acts as controller that sends signals to the elements of the decorators. The computer 300 provides controls, commands, or signals which determine a shape of the desired pattern of ink 112 transferred from the plurality of inkjet printing heads 108 to the printing surface 132 of the image transfer belt 116. A length of the desired pattern of ink 112 on the image transfer belt 116 preferably corresponds to a length of a segment of the endless image transfer belt 116 which is either less than or equal to a circumference of each beverage container body 14 or greater than or equal to a circumference of each beverage container body 14.

Using the computer system 300 in combination with the printing modules 100 and the beverage container handling module 200, the beverage container body decorators 10 continuously and without interruption decorates a queue of substantially identical beverage container bodies 14 with a plurality of finished arts wherein each finished art in the plurality of finished arts is unique relative to a remaining population of finished arts in the plurality of finished arts. In other words, there is no limit to the number of different finished designs or ink patterns that can be delivered to consecutively decorated beverage container bodies 14.

The computer system 300 described herein can be used in conjunction with any of the apparatuses described. Communication between the computer system and the decorating apparatus can be achieved via a conventional wireless signal using, for example, a modem or the like, as shown, or via a conventional wire signal, as also shown.

Methods of Decorating

While several methods of decorating container bodies have been expressly and inherently described with respect to the embodiments described above, the inventors further contemplate the following methods.

A first container body decorating method comprises the steps of: (1) delivering an ink pattern from an inker unit comprising a plurality of ink jet heads to an endless image belt; (2) providing a plurality of impression rolls, each impression roll inserted within an interior space of a corresponding container body in a plurality of container bodies to support the corresponding container body thereon; (3) transferring each of the impression rolls one-by-one to a printing site; rotating the endless image transfer blanket to transport the ink image to the printing site; (4) engaging each container body one-by-one with the endless image transfer belt at the printing site; (5) rotating each container body during a corresponding engaging step; and (6) transferring the ink pattern to each container body during a corresponding rotating step. The step of transferring the ink pattern to each container body during a corresponding rotating step may be performed continuously, without interruption, on the plurality of container bodies delivered consecutively to the printing site. Alternatively, the transferring each of the impression rolls to a printing site step may be performed by an indexer which indexes each container body to the printing site, wherein the transferring the ink pattern to the container body during a corresponding rotating step is performed during a dwell period, and wherein the indexer is stationary with respect to the transferring each of the impression rolls to a printing site step. A rotation may be imparted to each container body by a rotation of the impression roll. Alternatively, a rotation may be imparted to each container body through engagement with the endless image transfer belt. Each impression roll may be produced from an electroactive polymer.

The first method may further comprise the step of: transferring each container body to a corresponding impression roll wherein each corresponding impression roll is located within an interior space of each container body and a sidewall of each container body is supported thereby during the transferring the ink pattern to the container body during a corresponding rotating step.

The first method may further comprise the steps of: expanding each impression roll within the corresponding container body prior to the rotating step.

The first method may further comprise the step of: contracting each impression roll within the corresponding container body subsequent to the rotating step.

The first method may further comprise the step of: engaging the endless image transfer belt with a pressure member located opposite the impression roll during transferring the ink pattern to each container body during a corresponding rotating step.

A second container body decorating method comprising the steps of: (1) delivering an ink pattern from an inker unit comprising a plurality of ink jet heads to an endless image belt; (2) providing an impression roll; providing relative movement between the impression roll and a corresponding container body in a plurality of container bodies; (3) locating the impression roll within an interior space of the corresponding container body to support the corresponding container body thereon at a printing site; (4) rotating the endless image transfer blanket to transport the ink image to the printing site; (5) engaging the corresponding container body with the endless image transfer belt at the printing site; (6) rotating each container body during the engaging step; and (7) transferring the ink pattern to the container body during the rotating step.

While the specific embodiments have been illustrated and described, numerous modifications come to mind without significantly departing from the spirit of the invention, and the scope of protection is only limited by the scope of the accompanying Claims.

What is claimed is:

1. A container body decorator comprising:

a controller having a software routine stored on a memory;

a plurality of ink-jet print heads in communication with the controller;

an endless image transfer belt having a circumferential configuration with an inner surface opposite a printing surface, wherein a relief band is recessed into the printing surface of the endless image transfer belt and is configured to align with an edge of an open end of a container body such that the edge is spaced from the printing surface during a transfer of ink from the endless image transfer belt to the container body;

a print site; and a container body handling module.

2. The container body decorator of claim 1 wherein the container body handling module comprises a plurality of impression rolls movable relative to the printing site.

3. The container body decorator of claim 2 wherein each impression roll is configured to fit within an interior of each container body in a plurality of generally identical unadorned container bodies to be decorated by the container body decorator.

4. The container body decorator of claim 3 wherein each impression roll in the plurality of impression rolls transports one container body in the plurality of container bodies to the printing site.

5. The container body decorator of claim 4 wherein each container body in the plurality of container bodies contacts the printing surface of the endless image transfer belt at the printing site.

6. The container body decorator of claim 2 wherein the plurality of inkjet printing heads transfer ink in a desired pattern to the printing surface of the endless image transfer belt, wherein the endless image transfer belt traverses along a belt path driven by a drive roller to deliver the desired pattern to the printing site.

7. The container body decorator of claim 6 wherein a pressure member engages the inner surface of the endless image transfer belt at the printing site such that the printing surface carrying the desired pattern of ink is forced against one of the plurality of container bodies supported on one of the plurality of impression rolls as the one of the plurality of container bodies rotates about the center axis of the one of the plurality of impression rolls as the one of the plurality of impression rolls also orbits the central hub.

8. The container body decorator of claim 7 wherein forced air is used to deliver a container body onto an impression roll.

9. The container body decorator of claim 7 wherein a mechanical force is used to deliver a container body onto an impression roll.

10. The container body decorator of any of claim 1 wherein the container body decorator continuously and without interruption decorates a queue of substantially identical container bodies with a plurality of finished arts.

11. The container body decorator of claim 1 wherein the plurality of inkjet printer heads apply ink directly to the endless image transfer belt.

12. The container body decorator of claim 1 wherein a plurality of tension members engage the inner surface of the endless image transfer belt.

13. The container body decorator of claim 12 wherein each of a plurality of tension members engage the printing surface of the endless image transfer belt.

14. The container body decorator of claim 1 wherein a cleaner member engages the printing surface to remove excess ink from the endless image transfer belt.

15. The container body decorator of claim 14 wherein the cleaner member is selected from the group consisting of a cleaner roll, a scraper, a brush, a fluid bath, a fluid sprayer member, and any combination thereof.

16. The container body decorator of claim 1 wherein the endless image transfer belt comprises one or more relief features engraved into the printing surface.

17. The container body decorator of claim 1 further comprising a plurality of printing sites.

18. The container body decorator of claim 17 wherein a separate pressure member is associated with each printing site in the plurality of printing sites.

19. The container body decorator of claim 18 wherein the container handling module comprises a plurality of indexers, each comprising a plurality of impression rolls.

20. The container body decorator of claim 1 the container body handling module includes a serpentine path followed by a plurality of impression rolls, wherein each container body in a plurality of container bodies is supported on a corresponding impression roll in the plurality of impression rolls.

21. The container body decorator of claim 1 wherein the endless image transfer belt may be selectively disengaged or spaced from the printing site wherein a container body selectively bypasses contact with the endless image transfer belt, or wherein a container body is selectively disengaged or spaced from the endless image transfer belt at the printing site wherein the container body selectively bypasses contact with the endless image transfer belt.

* * * * *